US005412410A

United States Patent [19]

Rezanka

[11] Patent Number: 5,412,410

[45] Date of Patent: May 2, 1995

[54] INK JET PRINTHEAD FOR CONTINUOUS TONE AND TEXT PRINTING

[75] Inventor: Ivan Rezanka, Pittsford, N.Y.

[73] Assignee: Xerox Corporation, Stamford, Conn.

[21] Appl. No.: 375

[22] Filed: Jan. 4, 1993

[51] Int. Cl.[6] ..... B41J 2/05; B41J 2/205

[52] U.S. Cl. ..... 347/15; 347/47; 347/40; 347/52

[58] Field of Search ..... 346/140 R, 1.1; 347/15, 347/13, 12, 17, 40, 41, 42

[56] References Cited

U.S. PATENT DOCUMENTS

| | | | |
|---|---|---|---|
| Re. 32,572 | 1/1988 | Hawkins et al. | 156/626 |
| 3,864,696 | 2/1975 | Fischbeck | 346/140 R |
| 3,977,007 | 8/1976 | Berry et al. | 346/1 |
| 4,280,144 | 7/1981 | Bacon | 358/280 |
| 4,353,079 | 10/1982 | Kawanabe | 346/140 R |
| 4,412,226 | 10/1983 | Yoshida | 346/1.1 |
| 4,746,935 | 5/1988 | Allen | 346/140 R |
| 4,774,530 | 9/1988 | Hawkins | 346/140 R |
| 4,999,646 | 3/1991 | Trask | 346/11 |
| 5,012,257 | 4/1991 | Lowe et al. | 346/1.1 |
| 5,016,191 | 5/1991 | Radochonski | 364/518 |
| 5,059,989 | 10/1991 | Eldridge et al. | 346/140 R |
| 5,121,143 | 6/1992 | Hayamizu | 346/140 R |
| 5,208,605 | 5/1993 | Drake | 346/140 R |

*Primary Examiner*—Benjamin R. Fuller
*Assistant Examiner*—Valerie Ann Lund

[57] ABSTRACT

A thermal ink jet printhead has two or more groups of selectively activatable heating elements and associated nozzles with the heating elements and nozzles within each group having the same geometric parameters, but the geometric parameters of the heating elements and nozzles between groups being different, so that the ejection of droplets from the nozzles of different groups have different ink volumes. When continuous tone and grey scale printing is desired various combinations of nozzles from different groups are used to compose a halftone cell, and when high resolution text printing is desired, either the nozzles from one group or the nozzles from both groups in fixed combinations are used to eject ink droplets onto a recording medium.

5 Claims, 23 Drawing Sheets

INK JET PRINTHEAD FOR CONTINUOUS TONE AND TEXT PRINTING

BACKGROUND OF THE INVENTION

This invention relates to thermal ink jet printheads and more particularly to thermal ink jet printheads having optimized continuous tone to high resolution text printing performance through control of image area coverage.

In one approach to continuous tone and/or grey scale printing, a pixel location may be printed with one to seven droplets, thus providing eight grey scale levels. This requires repeated use of the printhead heating elements to eject ink droplets from the printhead nozzles, thus decreasing the heating element life times and imposing a reduced printing rate. In another approach to continuous tone printing, as disclosed, for example, by U.S. Pat. 4,353,079 to Kawanabe, multiple ink droplet generators simultaneously eject droplets in different numbers to achieve different corresponding ink droplet volumes at the same pixel locations. This type of grey scale printer requires that the nozzles be critically aligned with respect to each other, so that the ink droplets will properly register within the pixel location on the recording medium.

U.S. Pat. No. 4,746,935 to Allen discloses a thermal ink jet printer having three binary weighted drop generators which are fired in sequence to produce an eight-level halftone printing process. One, two, or all three drop generators sequentially eject droplets of varying volume to the same pixel location as the drop generators are scanned across a recording medium. For multicolor printing, each ink color has a separate series of three binary weighted drop generators.

U.S. Pat. No. 5,059,989 to Eldridge et al. discloses a thermal ink jet printer having its heating elements on the edge of a substrate with its addressing electrodes and common return on opposing surfaces of the substrate. A second substrate with a recess which opens at one edge provides the ink reservoir, and a nozzle plate covers the edges. The nozzles in the nozzle plate are aligned with the heating elements and have recesses to direct the ink to the nozzles and provide ink flow barriers to prevent cross talk. For higher resolution printing, two printhead areas are combined with their nozzles staggered.

U.S. Pat. No. 3,977,007 to Berry et al. discloses shades of gray produced by an ink jet printer by depositing a predetermined number of drops at each dot or pixel location within a matrix cell. The number of drops of ink producing the desired shade is based upon the location of a dot within the matrix cell in which the number of drops are selectively adjusted by one. The desired darkness or tonal density of each dot in the cell is determined independently of every other dot in the cell. In this way, contrast can be maintained even if a white-black transition occurs in the middle of a cell.

U.S. Pat. No. 5,016, 191 to Radochonski discloses a pixel processor which converts the line descriptions from the main processor into a bit map for a half tone picture. The pixel processor initially stores input data from the main processor indicating intensity threshold levels for each pixel of a half tone cell. When processing each line, the pixel processor addresses and reads a succession of pixel data words out of the bit map, each pixel data word including at least one bit corresponding to a pixel along the path of the line. For each such bit, the pixel processor determines the half tone cell position of the corresponding pixel, determines whether the intensity threshold level assigned to that halftone cell position is lower than the intensity level of the line and sets the state of the bit accordingly. After suitable altering relevant bits of each pixel data word, the pixel processor writes the altered pixel data word back into the bit map memory at the same address.

U.S. Pat. No. 4,280,144 to Bacon discloses an apparatus and method for improving the print quality of a coarse scan but fine print image processing device. A coarsely scanned pixel is assigned a grey scale code. The assigned code indicates the reflectance characteristics of the pixel. For fine reproduction of coarsely scanned data, the coarsely scanned pixel is summed with at least four adjacent horizontal and vertical pixels to reproduce a fine pixel comprising a cell of at least four sub-elements or printable pixels from a reproducing device, such as an ink jet printer.

U.S. Pat. No. 5,012,257 to Love et al. discloses a color ink jet printing system wherein each pixel of graphics data is processed to form a 2 by 2 array of cells, each cell corresponding to a pixel area on a recording medium. A 2 by 2 array of cells is referred to as a super pixel, and the graphics data is processed to form a superpixel for each color, indicating cell location and color of ink droplet to be applied to each cell. The superpixels are controlled so that ink droplets are deposited only in a diagonally adjacent pair of cells with no more than two ink droplets per cell and no more than three ink droplets per superpixel, thereby providing printed images having the desired color and color saturation, while minimizing bleed across color field boundaries.

U.S. Pat. No. 4,999,646 to Trask discloses a multiple pass complementary dot pattern ink jet printing process. Using this process, successive printed dots of adjacent rows are offset from each other, and successive printed swaths are made by depositing first and second partially overlapping complementary dot patterns on a recording medium. Thus, the dot spacing in coincident dot rows within the overlapping portions of the dot patterns is alternated between dots in the first pattern and dots in the second pattern.

U.S. Pat. No. 4,412,226 to Yoshida discloses a plurality of ink jet printheads to print arrays of cells, each cell in the array being printable with a variable size ink droplet to produce half tone images.

SUMMARY OF THE INVENTION

It is an object of the present invention to provide a thermal ink jet printhead for printing continuous tone or grey scale printing and high resolution text printing by controlling the area coverage of the printed image.

It is another object of the invention to provide a thermal ink jet printhead having at least two different groups of different sized nozzles from which ink droplets of different ink volumes are selectively ejected by the selective energization of heating elements associated therewith, whereby the nozzles of one group, or both groups, may be selectively used to print continuous tone and/or text.

In the present invention, a thermal ink jet printer has a printhead which ejects ink droplets onto a recording medium in a manner which controls area coverage by ejecting droplets from one of at least two groups of differently sized nozzles or from all of the nozzles. The printhead comprises two mated substrates, the confronting surface of one substrate contains an array of passivated heating elements and addressing electrodes and the other confronting substrate surface contains a plurality of channels which communicate alternately with nozzles from the at least two groups. Each nozzle group has nozzles of equal size, but each group of nozzles has a different nozzle size, so that a predetermined volume of ink is ejected from each of the different size nozzles.

In another embodiment, the linear arrays of heating elements and driver circuitry are formed on opposite surfaces of a first substrate, together with a common ink reservoir formed in the first substrate which communicates with the channels and nozzles. Second and third substrates, each having linear arrays of parallel ink channels and nozzles formed on one surface thereof, are aligned and bonded to the opposite surfaces of the first substrate to complete formation of the ink flow channels and nozzles and locate a heating element in each channel a predetermined distance upstream from the nozzle, so that the second and third substrates sandwich the first substrate therebetween.

When continuous tone or grey scale printing is desired, various combinations of nozzles from different groups are used to compose a halftone cell, and when high resolution text printing is desired, either the nozzles from one group or nozzles from both groups in fixed combination are used to eject ink droplets. The printhead may be a single unit or a plurality of such printhead single units which are abutted end-to-end on one surface of a structural bar or on opposing surfaces thereof to form a pagewidth printhead. If a single unit is used, it is mounted on a carriage for bidirectional traversal across the width of a recording medium. The recording medium is held stationary during the printing, then stepped the distance of a printed swath prior to successive subsequent traversals during which successive swaths are printed and the recording medium is stepped until the entire recording medium has been printed. If a pagewidth printhead is used, the printhead is fixedly mounted in the printer and the recording medium is moved therepast at a constant velocity and moved in a direction perpendicular to the printhead.

A more complete understanding of the present invention can be obtained by considering the following detailed description in conjunction with the accompanying drawings, wherein like index numerals indicate like parts.

DESCRIPTION OF THE PREFERRED EMBODIMENT

Figure 1:
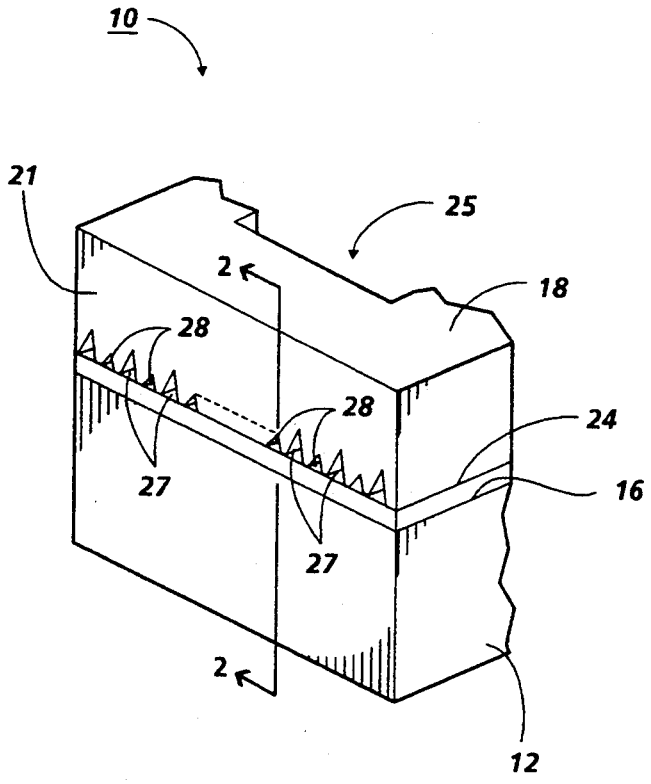
FIG. 1 is an enlarged, partially shown, schematic isometric view of the printhead of the present invention as a single unit for a carriage type printer, showing a heater plate and channel plate mated together with a thick film layer sandwiched therebetween and showing two groups of differently sized nozzles alternately spaced on equal centers.
Figure 2:
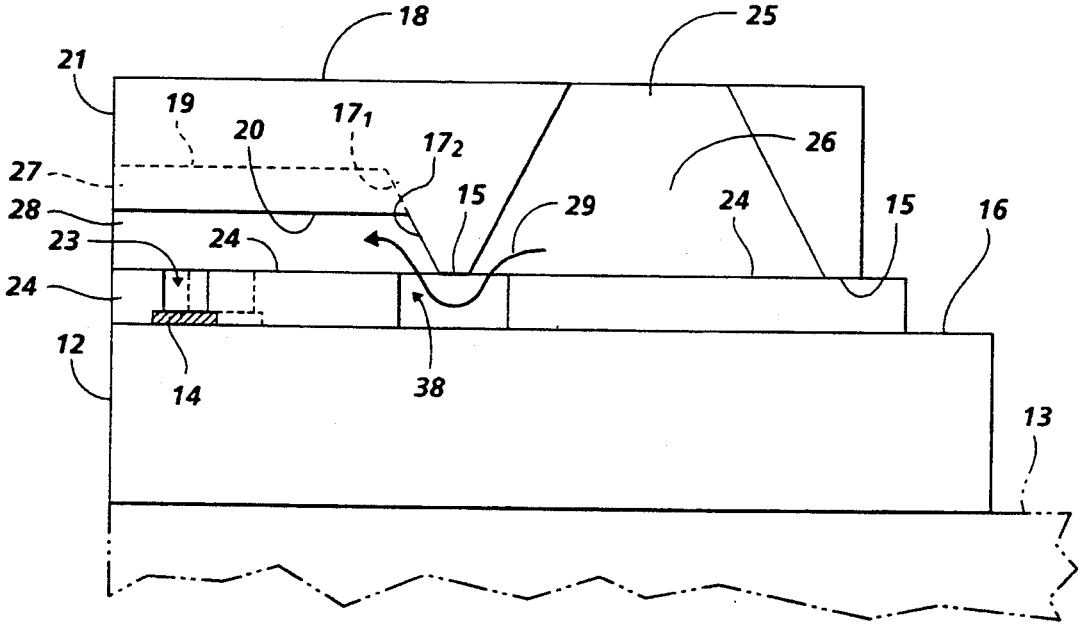
FIG. 2 is an enlarged, cross-sectional view of FIG. 1 as viewed along view line 2—2 through one of the nozzles thereof.

In FIG. 1, an enlarged, schematic isometric view of the printhead 10 is shown with a linear array of nozzles in the front edge or face 21 having two different sizes, large and small nozzles 27, 28, respectively, equally spaced with alternating sizes along the array. Referring also to FIG. 2, discussed later, the lower electrically insulating substrate or heater plate 12 has the heating elements 14 and addressing electrodes (not shown) patterned on surface 16 thereof, while the upper substrate or channel plate 18 has alternate large and small parallel grooves 19, 20, respectively, which extends in one direction and penetrate through the upper substrate front face edge 21 forming nozzles 27, 28. The other end of the large and small grooves each terminate at slanted wall $17_1$, $17_2$, respectively, which is adjacent to an internal recess 26. Internal recess 26 is used as the ink supply reservoir to fill ink channels 19, 20 by capillary action. The reservoir 26 extends through the thickness of the channel plate and its open bottom is used as an ink inlet 25. The surface of the channel plate with the grooves are aligned and bonded to the heater plate 12, so that a respective one of the plurality of heating elements 14 is positioned in each channel, formed by the grooves and the heater plate. Ink enters the reservoir formed by the recess 26 and the heater plate 12 through the inlet 25 and, by capillary action, fills the channels 19, 20 by flowing through an elongated recess 38 formed in the thick film insulating layer 24. The ink at each nozzle is under a slightly negative pressure and forms a meniscus, the surface tension of which prevents the ink from weeping therefrom. Layer 24 is a thick film passivation layer, discussed later, sandwiched between the heater plate and channel plate. This layer is etched to expose the heating elements, thus placing them in a pit 23, and is etched to form the elongated recess 38 to enable ink flow between the manifold 26 and the ink channels 19, 20, as disclosed in U.S. Pat. No. 4,774,530 to Hawkins, incorporated herein by reference in its entirety.

A cross-sectional view of FIG. 1 is taken along view line 2—2 through one small channel 20 and shown as FIG. 2 to show how the ink flows from the manifold 26 and around the slanted wall 17 of the grooves 19, 20 as depicted by arrow 29. As is disclosed in U.S. Pat. No. 4,774,530, mentioned above, a plurality of sets of bubble generating heating elements 14 and their addressing electrodes are patterned on one of the polished surfaces of a two side polished (100) silicon wafer. A plurality of printheads 10 may be assembled on one surface of a structural bar 13, shown in dashed line in FIG. 2, in an end-to-end abutting fashion to form a pagewidth printhead. Other pagewidth printheads are discussed later with respect to FIGS. 12 -15.

In the preferred embodiment, polysilicon heating elements are used and a silicon dioxide thermal oxide layer (not shown) is grown from the polysilicon in high temperature steam. The thermal oxide layer is typically grown to a thickness of 0.5 to 1 micrometer to protect and insulate the heating elements from the conductive ink. The thermal oxide is removed at the edges of the polysilicon heating elements for attachment of the addressing electrodes (not shown), which are then patterned and deposited. Before electrode passivation, a tantalum (Ta) layer (not shown) may be optionally deposited to a thickness of about 1 micrometer on the heating element protective layer for added protection thereof against the cavitational forces generated by the collapsing ink vapor bubbles during printhead operation. For electrode passivation, a two micrometer thick phosphorous doped CVD silicon dioxide film (not shown) is deposited over the entire wafer surface, including the plurality of sets of heating elements and addressing electrodes. The passivation film provides an ion barrier which will protect the exposed electrodes from the ink. Other ion barriers may be used, such as, for example, polyimide and plasma nitride. An effective ion barrier layer is achieved when its thickness is between 1000 angstrom and 10 micrometers, with the preferred thickness being 1 micrometer. Next, a thick film type insulative layer 24, such as, for example, polyimide, is formed on the passivation layer having a thickness of between 10 and 100 micrometers and preferably in the range of 25 to 50 micrometers. The thick film layer 24 is photolithographically processed to enable etching and removal of those portions of the layer 24 over each heating element (forming pits 23), and the elongated recess 38 for providing ink passage from the manifold 26 to the ink channels 19, 20.

As disclosed in U.S. Pat. Nos. Des. 32,572 and 4,774,530, the channel plate is formed from a two side polished, (100) silicon wafer (not shown) to produce a plurality of channel plates for the printhead. After the wafer is chemically cleaned, a pyrolytic CVD silicon nitrite layer (not shown) is deposited on both sides. The silicon nitride layer on one side of the wafer is photolithographically patterned to form a plurality of relatively large vias and a plurality of sets of elongated parallel channel vias having equal lengths but alternating predetermined widths, which, when placed in an anisotropic etch bath, form the relatively large rectangular recesses 26 and sets of elongated, parallel channel recesses 19, 20 having alternating large and small cross-sectional areas that will eventually become the ink reservoirs and channels of the printheads. After the ink reservoirs and channels have been etched, the silicon nitride layer is preferably removed. The surface 15 (see FIG. 2) of the channel plate containing the reservoir and channel recesses are portions of the original wafer surface on which adhesive will be applied later for bonding it to the substrate containing the plurality of sets of heating elements with patterned thick film layer thereover. The mated wafers, with the patterned thick film layer therebetween, is then sectioned into a plurality of individual printheads, by, for example, a dicing procedure. One of the final dicing cuts produces end face 21, opens one end of the elongated grooves 19, 20 producing nozzles 27, 28. The other ends of the channel grooves 19, 20 remain closed by ends 17. However, the alignment and bonding of the channel plate to the heater plate places the ends $17_1$, $17_2$ of channels 19, 20 directly over elongated recess 38 in the thick film insulative layer 18 as shown in FIG. 2 enabling the flow of ink into the channels from the reservoir as depicted by arrow 29. Elongated recess 38 may be a linear array of individual elongated recesses, one for each channel and having the same width as its respective channel.

Figure 3:
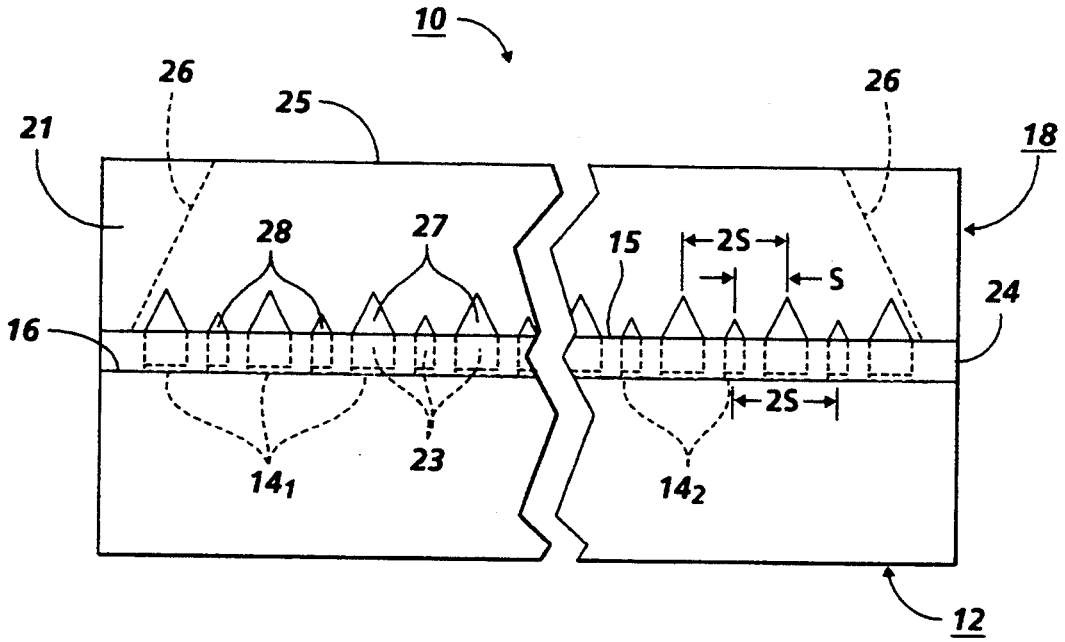
FIG. 3 is a front view of the printhead of FIG. 1.
Figure 4:
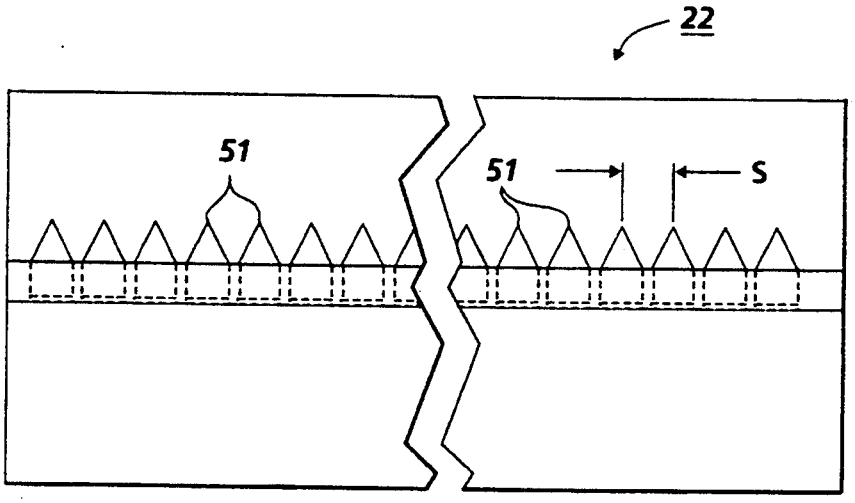
FIG. 4 PRIOR ART
FIG. 4 is a front view of a typical prior art printhead.
Figure 8:
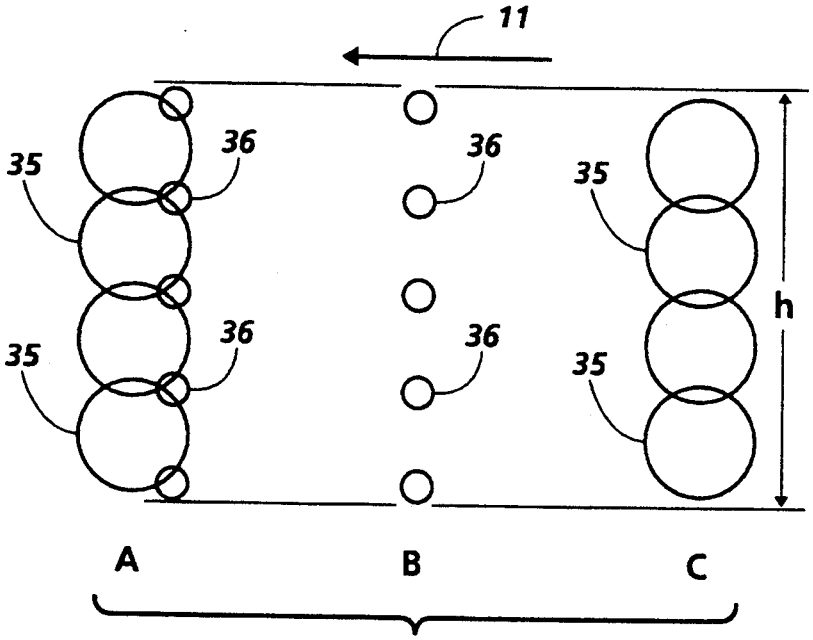
FIG. 8 shows three columns of printed droplets from the printhead of FIG. 1, two printed by the nozzles of each size separately and a third column of printed droplets printed by all of the nozzles in both sizes.
Figure 11:
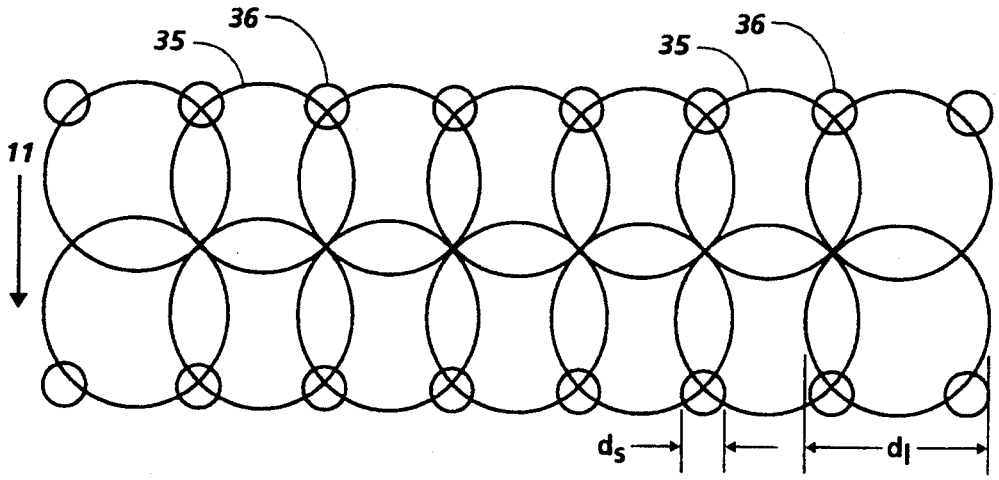
FIG. 11 shows printing from the printhead of the present invention.

An enlarged, schematic front view of the printhead 10 of FIG. 1 is shown in FIG. 3 to show more clearly the alternate size of the linear array of nozzles 27, 28. To form a pagewidth printhead, a plurality of the printheads 10 are assembled on opposite side of a structural bar (see FIG. 14) in an abutted, end-to-end relationship with the nozzles and nozzle faces all coplanar. In comparison with FIG. 3, FIG. 4 shows the nozzles 51 of a prior art printhead 22 having the same nozzle spacing "s", but the nozzles all have the same size. As discussed above, the printhead 10 of the present invention comprises a heater plate 12, channel plate 18, and intermediate thick film layer 24 sandwiched therebetween. The thick film layer is patterned to expose the heating elements $14_1$, $14_2$, shown in dashed line, thus placing them in pits 23, also shown in dashed line, and to form an elongated recess or trench 38 (see FIG. 2) between the channel slanted end walls $17_1$, $17_2$ and reservoir 26 to provide an ink flow path. The nozzle spacing is between 200 and 1600 per linear inch for all nozzles of alternating sizes and the nozzles are equally spaced. In one embodiment, the large nozzles 27 are spaced on 1/600 inch centers and the intervening small nozzles 28 are also spaced on 1/600 inch centers, so that the center-to-center distance between a large nozzle and its adjacent small nozzle is 1/1200 inch. The distance between each nozzle is "s", and the distance between the same size nozzle is "2s", so that the distance between the large and small nozzles in the same channel plate is "s"as shown in both FIGS. 3 and 6. Quality, high resolution printing of text images may be achieved, as shown in FIG. 11, by using either the large or small nozzles, but preferably both in fixed combination to eject ink droplets. The smaller nozzles in the embodiment, having s=1/600 inch or 42 μm, eject an ink droplet which produces a circular spot or dot 36 on the recording medium having a diameter ($d_s$) of about 10 μm. The larger nozzles in the embodiment, having s=1/600 inch or 42 μm, eject an ink droplet which produces a circular dot 35 on the recording medium having a diameter ($d_l$) of about 52 μm. Thus, the dots from the largest nozzles are about five times larger than the dots from the smaller nozzles. Referring to FIG. 8, column A shows a column of printed large and small dots or pixels 35, 36 from a single printhead oriented for bidirectional, reciprocal printing, so that the nozzle array is vertical and perpendicular to the reciprocating direction as indicated by arrow 11, wherein the ink droplets from both large and small printhead nozzles are used for text printing. Column B shows only small pixels printed and column C shows only large pixels printed. All of the columns have the same height "h", which is equal to the vertical height of the printhead 10.

Figure 10:
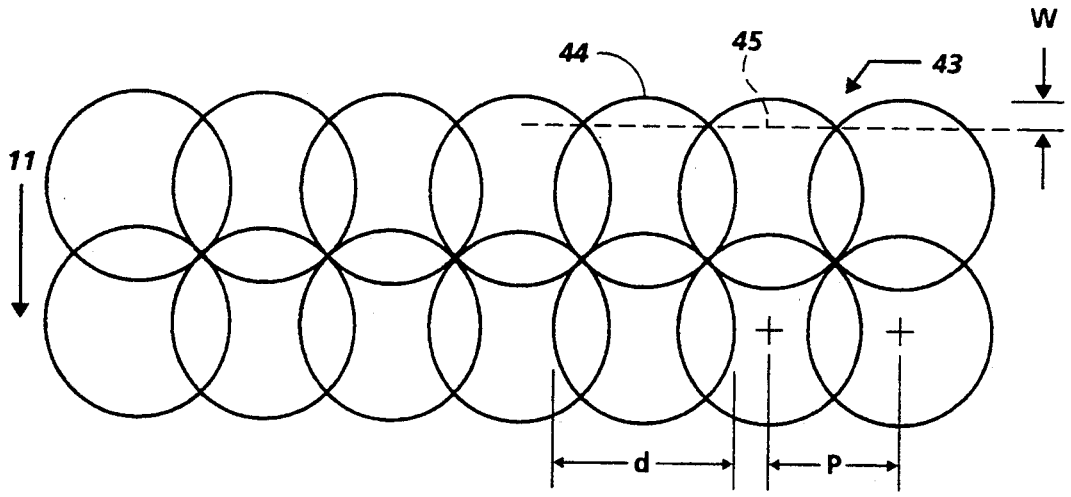
FIG. 10 PRIOR ART
FIG. 10 shows printing from a prior art printhead such as that shown in FIG. 4.

Referring to FIG. 10, two rows of slightly overlapping dots or pixels 44 are shown which have been printed by ink droplets from the single-sized nozzles of a prior art printhead 22 (FIG. 4), wherein the printhead reciprocating direction is shown by arrow 11. Note the scalloping or undulating effect 43 produced along the horizontal edge as indicated by the varying dimension "w"from the solid area coverage identified by dashed line 45. In FIG. 11, two rows of slightly overlapping pixels 35, 36 are shown which have been printed by ink droplets from the large and small nozzles of the present invention, wherein the printhead reciprocating direction is also shown by arrow 11. The large pixels 35 of FIG. 11 are about the same diameter as the pixels 44 in FIG. 10. However, the scalloping effect along the outer edges is reduced by the small pixels 36.

Figure 5:
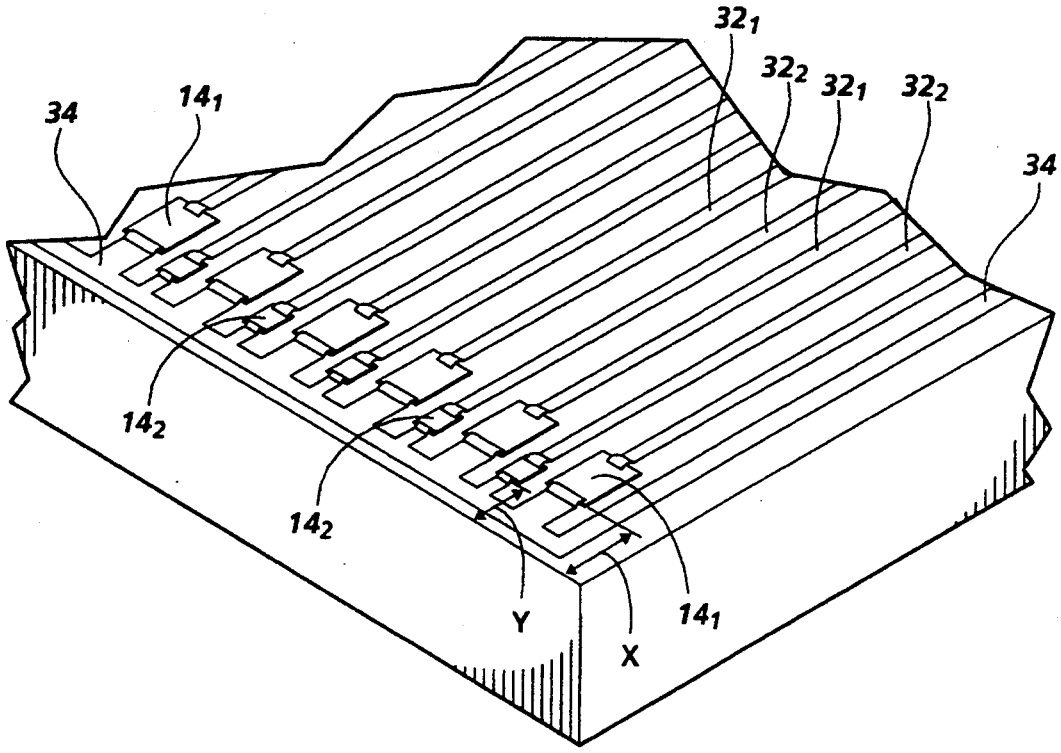
FIG. 5 is a partially shown, isometric view of the heater plate of FIG. 1 with the channel plate and thick film layer removed to show the different sized heating elements thereon.

Referring to FIG. 5, an enlarged, partially shown, isometric view of the heater plate 12 is shown, depicting the heating elements $14_1$, $14_2$ and addressing electrodes $32_1$, $32_2$ and common return 34, prior to laminating the thick film layer 24 of polyimide thereon. As is well known in ink jet technology, the nozzle and associated channel size have a direct relationship on the size and location of the heating element relative to its nozzle. Thus, the smaller nozzles may have smaller heating elements $14_2$ which are located a predetermined distance Y upstream from the nozzles, while the larger nozzles may have a larger heating element $14_1$ which are located a predetermined distance X upstream from the nozzle, in which distance X is greater than distance Y. The volume of ink between the heating elements and the nozzles determine the ink volume in a droplet ejected from the nozzles.

Figure 6:
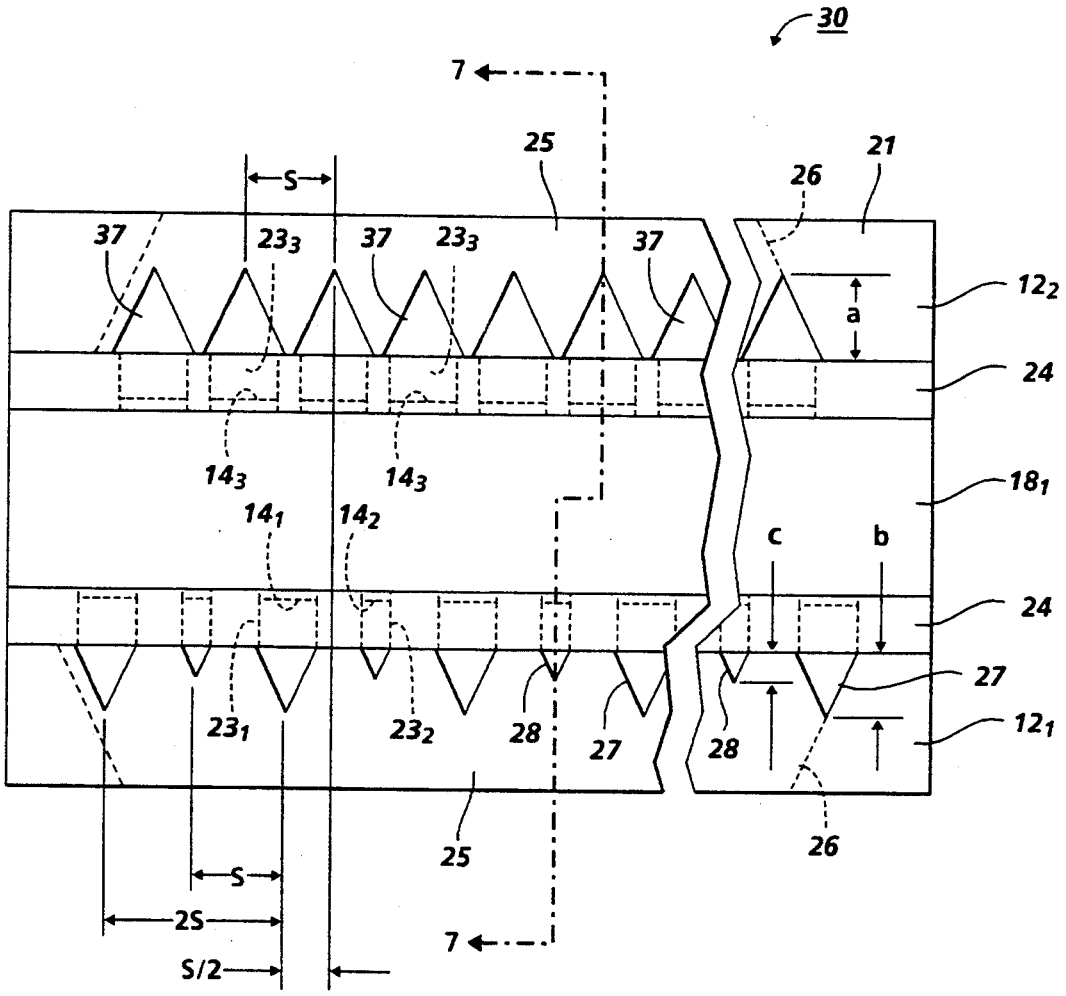
FIG. 6 is a front view of an alternate embodiment of a single printhead unit of the present invention.
Figure 7:
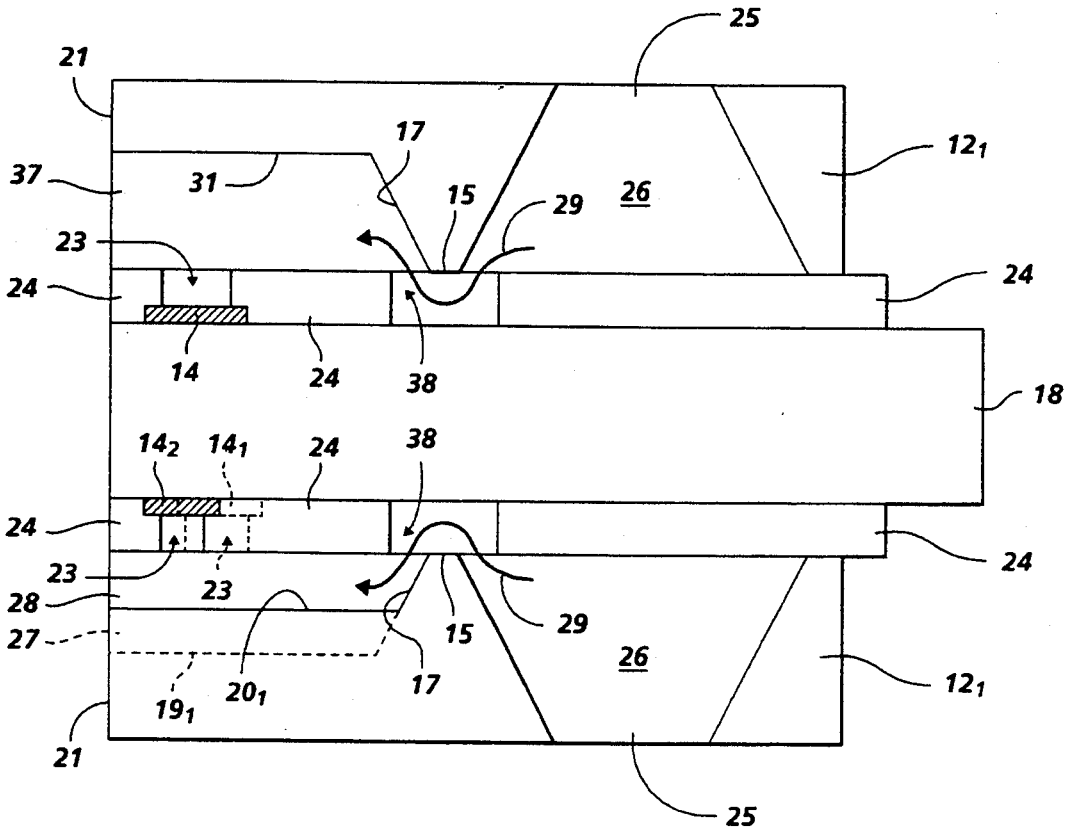
FIG. 7 is a cross-sectional view of the printhead of FIG. 6 as viewed along view line 7—7 thereof.

FIG. 6 is an enlarged, schematic front view of printhead 30, an alternate embodiment of the printhead 10 in FIG. 1 and similarly fabricated, and FIG. 7 is a cross-sectional view of the printhead 30 as viewed along view line 7—7 in FIG. 6. Printhead 30 is fabricated from a combination of three wafers (not shown), using one heater wafer with heating elements $14_1$ and $14_2$ together with associated addressing circuitry on one surface and heating elements $14_3$ with associated addressing circuitry on the opposing surface and two channel wafers. Thick film layers 24 of polyimide are formed on the heater wafer surfaces having the heating elements $14_1$, $14_2$, $14_3$ and addressing circuitry, so that when the two channel wafers 18 having channels and reservoirs on one surface thereof are aligned and bonded to the opposite surfaces of the heater wafer, the polyimide layer 24 is sandwiched between each channel wafer and the heater wafer. The thick film layers 24 are patterned in a manner similar to that for the printhead of FIGS. 1–3 to form pits $23_1$, $23_2$, $23_3$ over the heating elements and ink flow by-passes 38. The array of largest channels 31 (FIG. 7) is in the surface of one channel wafer having largest nozzles 37, while the medium and smallest channels $19_1$, $20_1$, respectively, providing nozzles 27, 28, respectively, are in one surface of the other channel wafer in alternating manner, but at the same number per linear inch as indicated by the center-to-center spacing "s". The nozzles 37 are offset from the alternating medium and smallest nozzles 27, 28, respectively, by one-half spacing s/2.

After the two channel wafers are aligned and bonded to the opposite surfaces of the heater plate $18_1$, the wafers are sectioned into a plurality of individual printheads 30. The channel plates or wafers are fabricated as disclosed above, while the heater wafer must have the sets of heating element arrays and associate addressing circuitry formed on sides thereof. As shown in FIG. 6, the largest nozzles 37 have a height or altitude "a", intermediate nozzles $19_9$ have altitude "b", and smallest nozzles $20_1$ have altitude "c", and all of the anisotropically etched channels have triangular cross-sectional areas with walls following the {111} crystal planes of the silicon wafer. Accordingly, printhead 30 has increased printing resolution over the printhead 10 shown in FIGS. 1 through 3.

Figure 9:
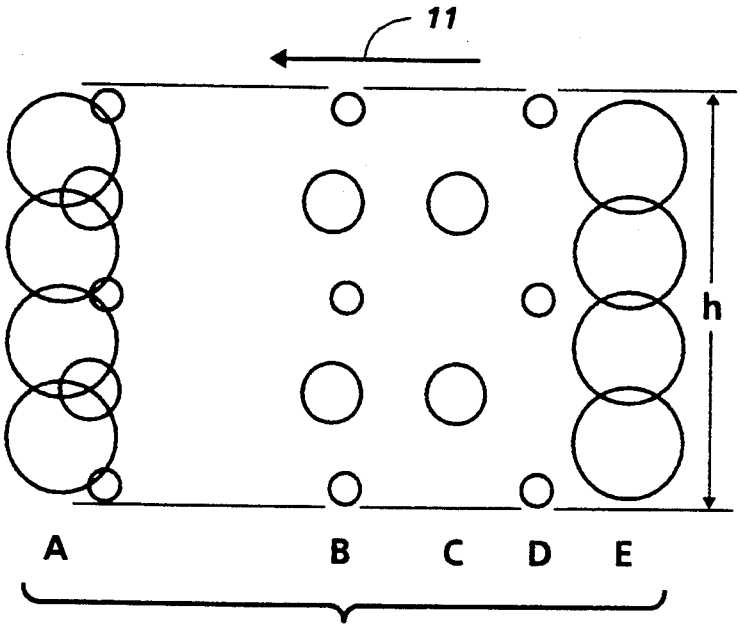
FIG. 9 shows five columns of printed droplets from the printhead of FIG. 6, three printed by the nozzles of each size separately and of the remaining two columns of printed droplets, one is printed by the nozzles on one side of the channel plate having two different sizes and one is printed by all of the nozzles from both sides of the channel plate.

Referring to FIG. 9, five columns A through E of printing are shown. As in FIG. 8, the printhead 30 of FIG. 6 is oriented for bidirectional, reciprocal printing, so that the nozzles are vertical and perpendicular to the reciprocating direction as indicated by arrow 11. Column A shows a column of pixels printed by droplets ejected from all nozzles, whereas the column of pixels printed in column B are printed from the intermediate and smallest nozzles 27, 28 from one side of the printhead channel plate 18, and the column of pixels printed in column E is by droplets from the largest nozzles 37 on the other side of the printhead channel plate. Pixels printed in columns C and D are from the droplets ejected separately from the intermediate and smallest nozzles. The column height for all of the printed columns is indicated by the distance "h "and represents the total printing width of the printhead. After each swath of printing by the printhead, the recording medium (not shown) is stepped the distance h and the next swath is printed. The recording medium is stepped after each swath is printed until the entire surface of the recording medium is covered with print.

Figure 12:
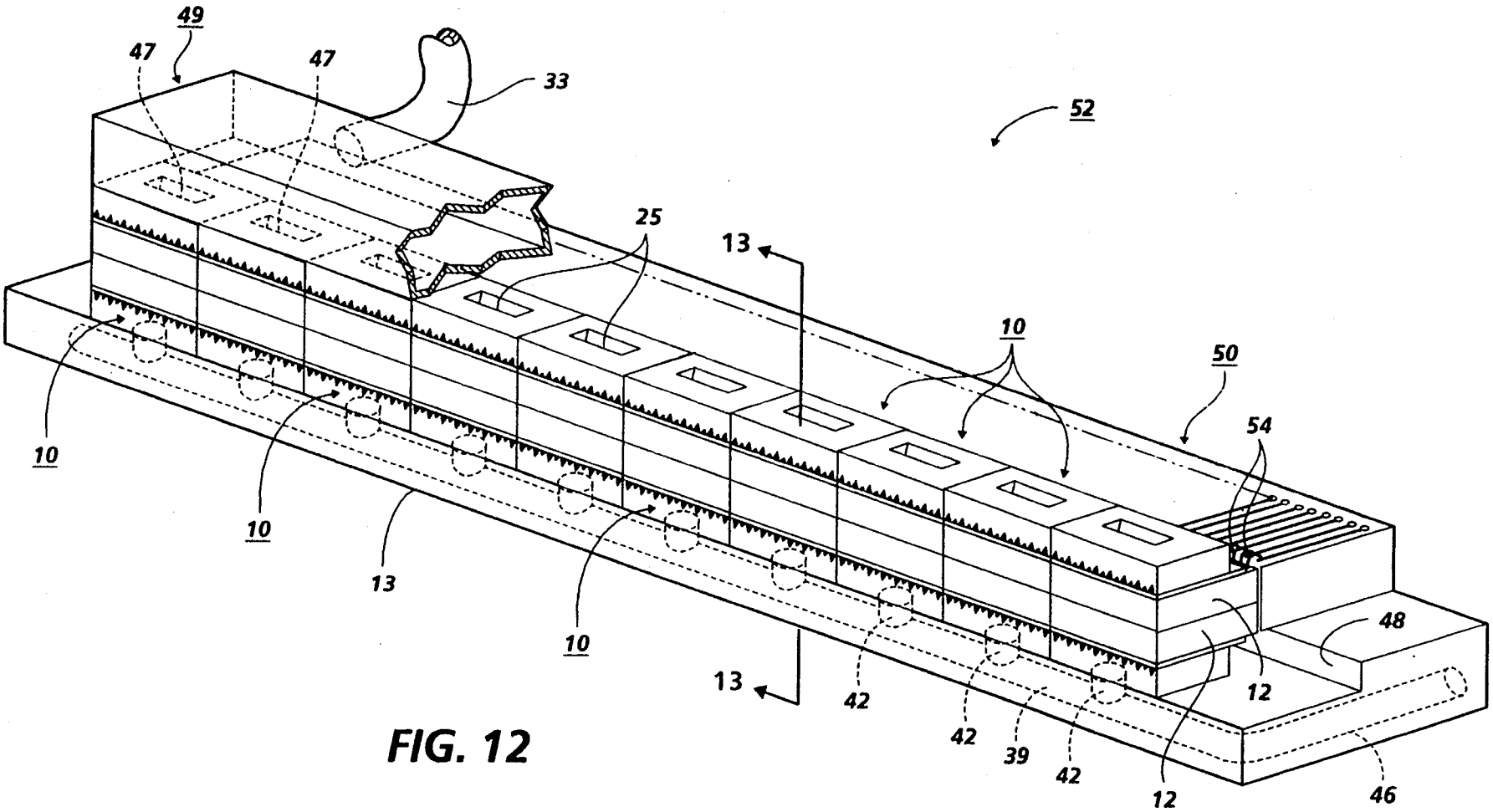
FIG. 12 shows a pagewidth printhead comprising a plurality of single units of the printhead unit of FIG. 1, the printhead units being stacked heater plate to heater plate and abutted on a structural bar.
Figure 13:
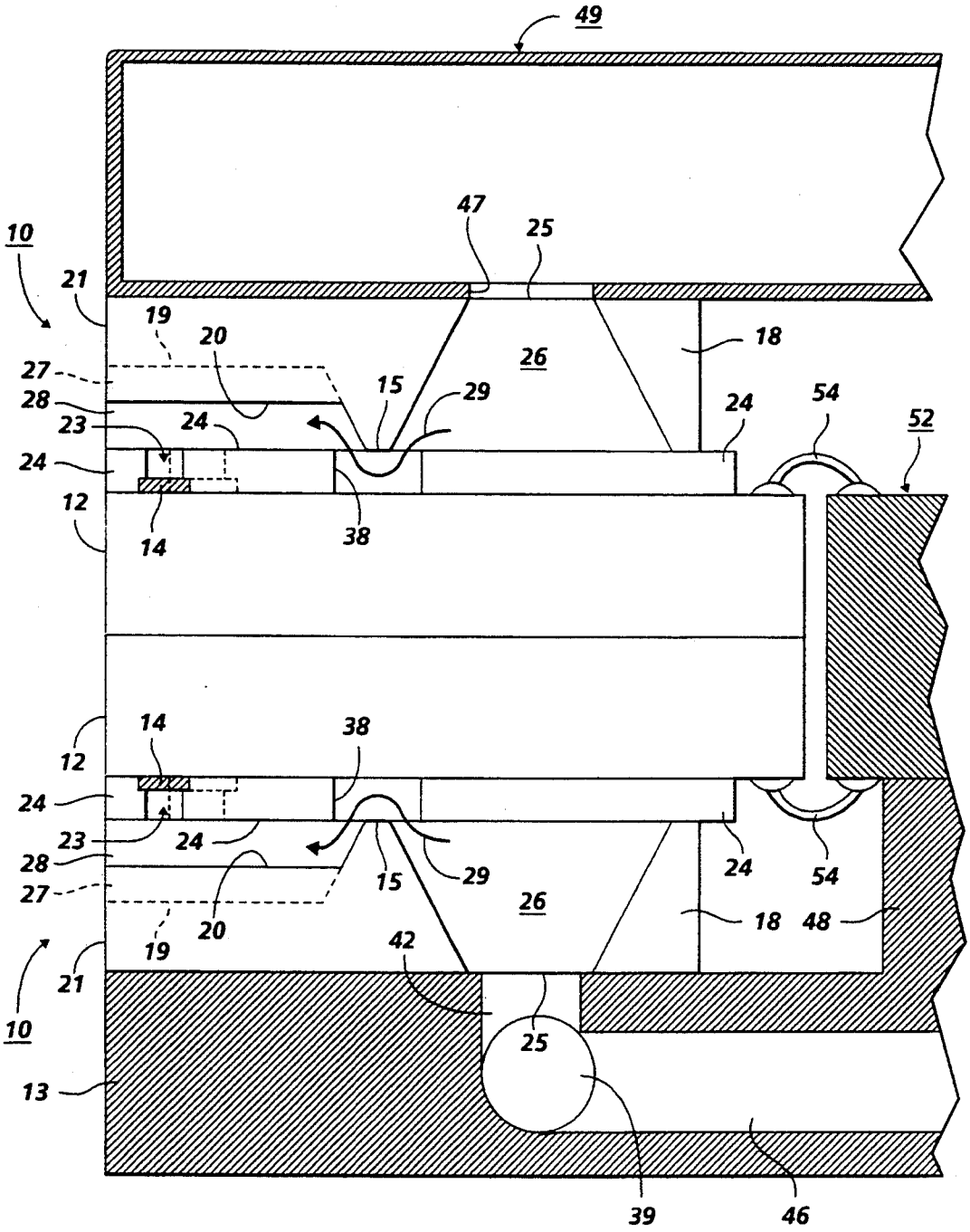
FIG. 13 is a partially shown, cross-sectional view of the pagewidth printhead as viewed along view-line 13—13 of FIG. 12.

FIG. 12 is a schematic isometric view of a pagewidth printhead 52 assembled by the end-to-end abutment of a plurality of printheads 10 on a structural bar 13. The pagewidth printhead may be assembled by mating separate printheads 10, as shown in FIGS. 1 and 2, so that their nozzles and nozzle faces are coplanar and their ink inlets are aligned and mated. A first row of abutted printheads are inverted so that their inlets 25 are aligned with internal opening 42 as they lie in contact with a surface of the structural bar 13. A common internal passageway 39 is connected to an ink supply (not shown) by internal conduit 46 while internal openings 42 place the printhead inlets 25 into communication with the common passageway 39. A second row of abutted printheads 10 resides on top of the first row with their heater plates 12 in contact with each other. The inlets 25 of the second row of printheads are supplied ink from ink manifold 49 through manifold outlets 47 which are aligned with the printhead inlets. Tube 33 is connected to the manifold 49 to maintain an appropriate supply of ink therein from an ink supply (not shown). A printed circuit board 50 is supported on a step 48 of the structural bar 13 and provides the electrical interface with the printer controller (not shown) and power supplies (not shown). The individual printheads 10 assembled to form the pagewidth printhead 52 are connected to the printer circuit board by wire bonds 54. FIG. 13 is a cross-sectional view of the pagewidth printhead 52, as viewed along view line 13—13. In this cross-sectional view, two rows of printheads 10 are mated, so that their inlets 25 are faced in opposite directions for receipt of ink, one from the manifold 49 and the other from the internal common passageway 39 in the structural bar 13. The structural bar not only serves as a source of ink, but also as a heat sink to control and manage the heat generated during the printing process. Alternatively, a single row of printheads 30 of FIGS. 6 and 7 could be assembled on the structural bar 13 to form another pagewidth printhead (not shown). This alternative pagewidth printhead differs from the pagewidth printhead 52 of FIG. 12 only in that it has a common heater plate instead of two separate heater plates.

Figure 14:
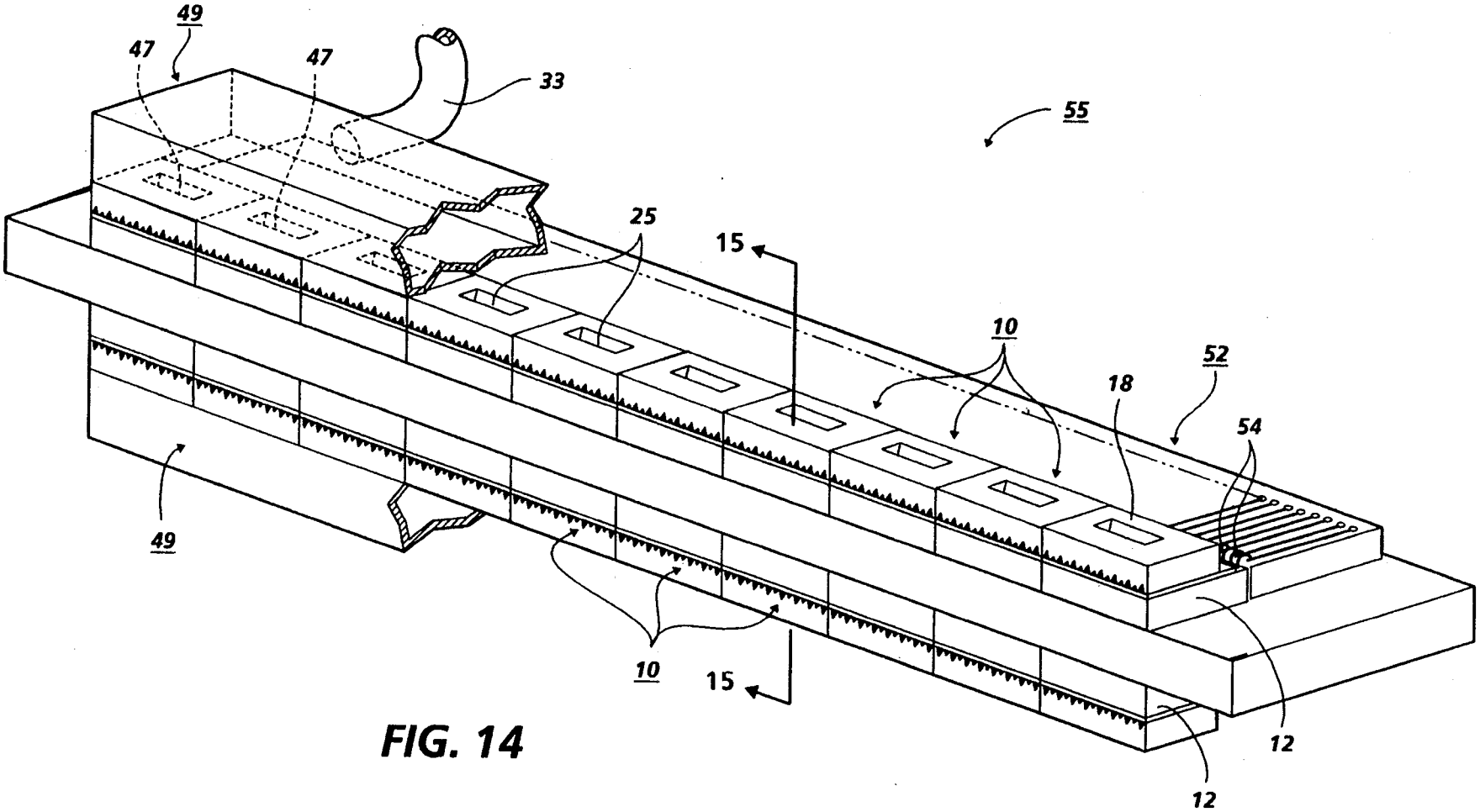
FIG. 14 shows an alternate embodiment of the pagewidth printhead of FIG. 12.
Figure 15:
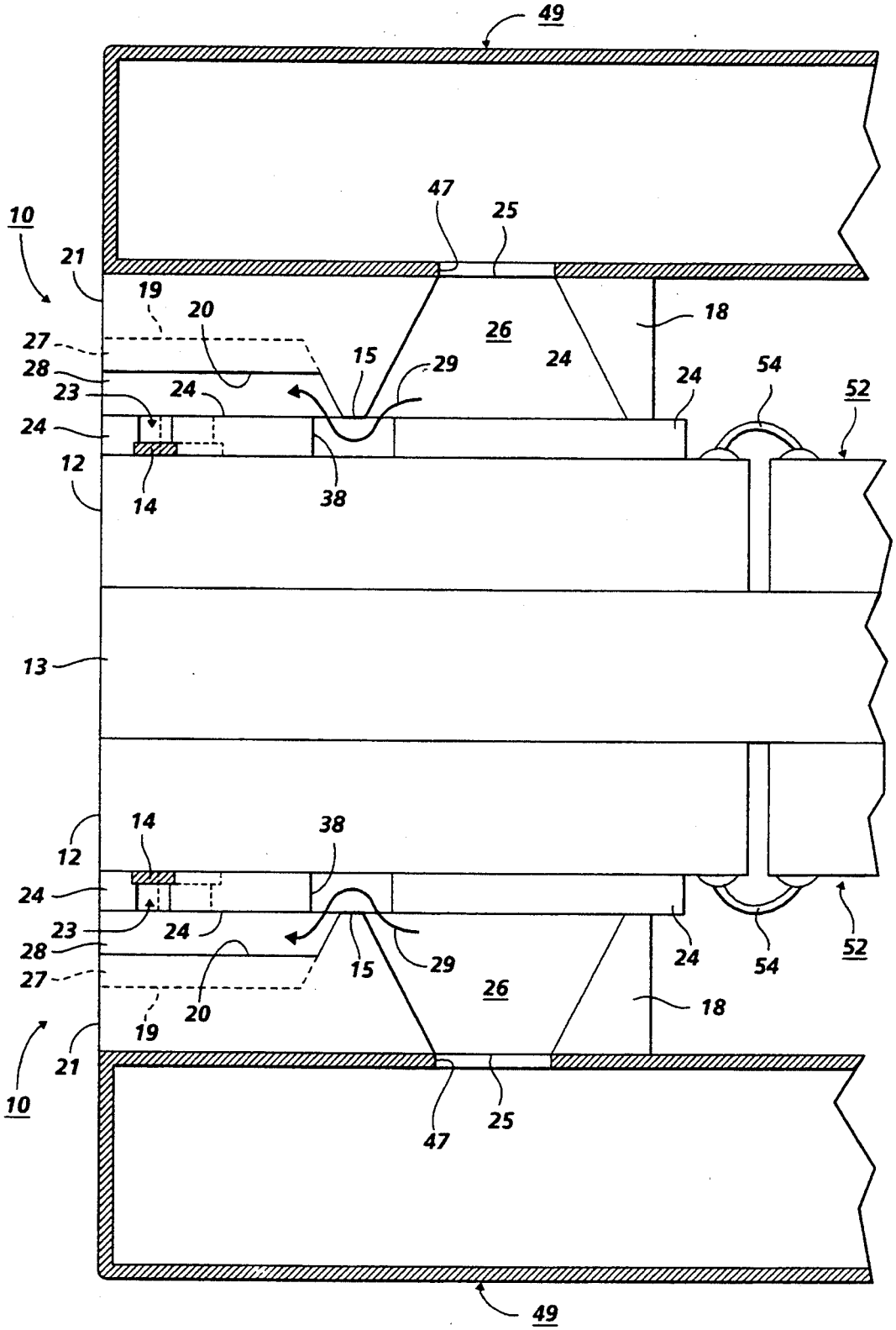
FIG. 15 shows a cross-sectional view of the pagewidth printhead of FIG. 14 as viewed along viewline 15—15 thereof.

FIG. 14 is a schematic isometric view of an alternate embodiment of a pagewidth printhead 55, and FIG. 15 is a cross-sectional view as viewed along view line 15—15 of FIG. 14. In this alternate embodiment, a plurality of printheads 10, as shown in FIGS. 1 and 2, are abutted end-to-end on opposite sides of a structural bar 13. This embodiment is similar to FIG. 12, except both ink supplies are external to the structural bar 13. The plurality of printheads 10 are mounted on opposing surfaces of the structural bar in an abutting relationship with the printhead heater plates 12 contacting the structural bar. The inlets 25 of the printhead channel plates 18 are directed in opposite directions. Ink manifolds 49 with openings 47 therein are sealingly attached to the printheads 10. The manifold openings 47 are aligned with the printhead inlets 25. The manifolds are maintained full of ink by tubes 33 which connect the manifolds 49 to an ink supply (not shown). Each row or printheads are connected to separate printed circuit boards 50 bonded to opposite sides of the structural bar 13 adjacent the heater plates 12 thereof and electrically connected thereto by wire bonds 54.

The printheads of this invention are adapted to print text or, when continuous tone or grey scale printing is desired, to print by halftone cells. Because the printheads of this invention have at least two different size nozzles which eject different size ink droplets, textural printing avoids the scalloping effect 43 shown in FIG. 10 and is capable of printing, therefore, higher resolution alphanumeric images with minimized scalloping effect.

Figure 16:
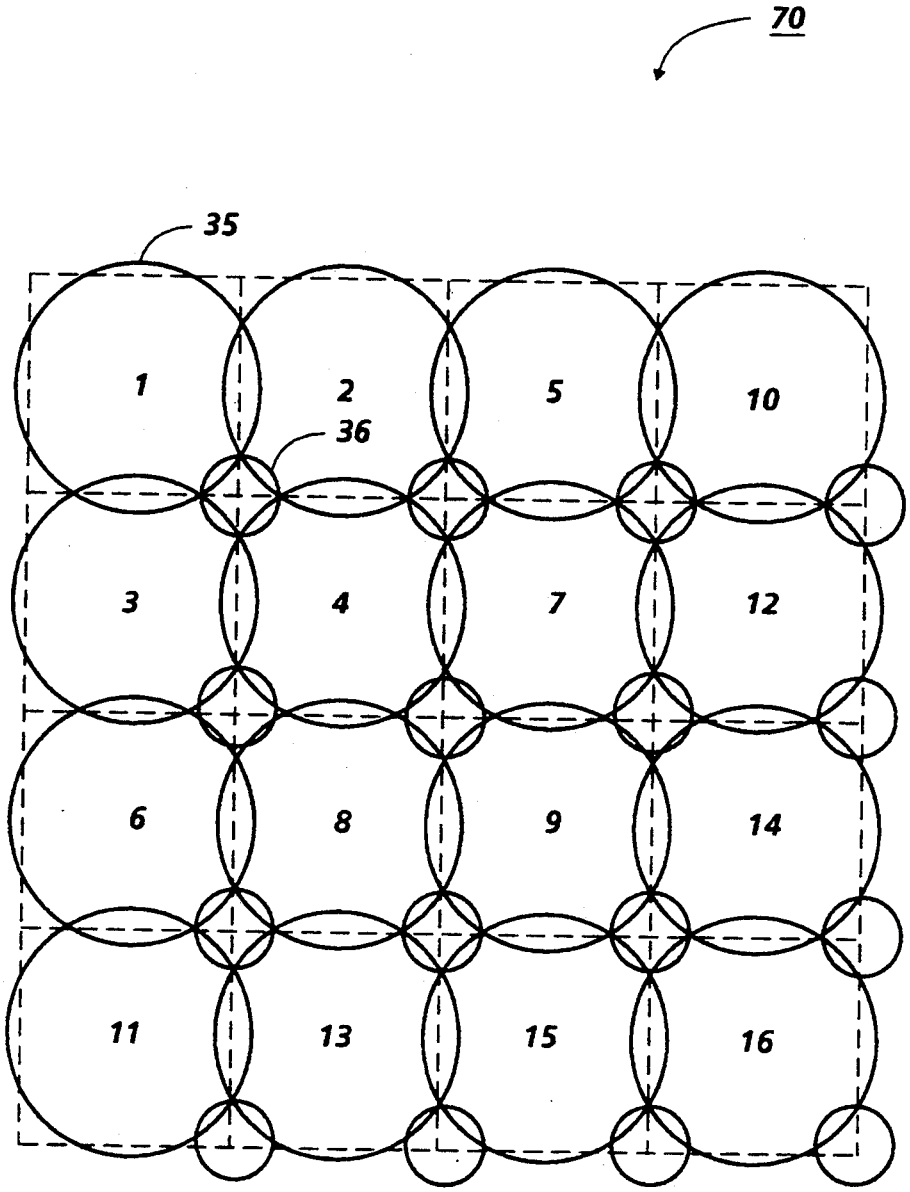
FIG. 16 shows a 150 screen halftone cell.
Figure 17:
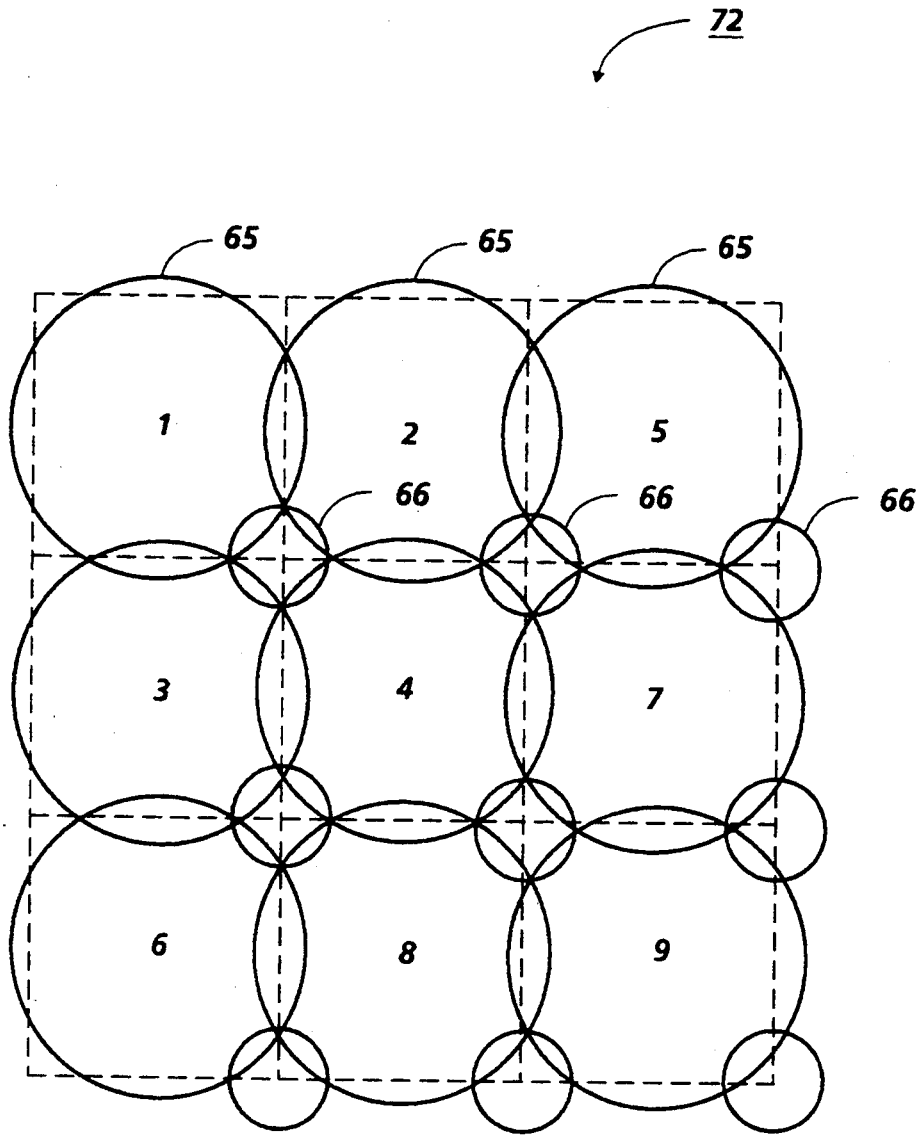
FIG. 17 shows a 200 screen halftone cell.

A major advantage of this invention is illustrated by way of two examples of constructing halftone cells 70, 72, one at 150 cells per linear inch (150 screen) shown in FIG. 16, the other at 200 cells per linear inch (200 screen) shown in FIG. 17. High quality offset lithography is achieving, at this cell density, sufficient number of absorbance steps, up to 200, to reproduce closely the well known continuous tone reproduction curve by these discrete steps, discussed later with respect to FIGS. 24 and 25. Continuous tone reproduction means the capacity of a given printer to reproduce an original having continuous absorbance or tone. The relation between the desired, or input absorbance, and the printed, or output absorbance is ideally a straight line with a slope equal to 1. In ink jet, the spots must partially overlap to achieve full area coverage which is needed for saturated color tones. In these examples, the image resulting from these overlapping spots is approximated by the geometrical union of the individual spots. This approximation is known to describe well the formation of the actual images. By way of example for prior art, whereby the image is formed by equal size spots, this condition establishes the relation between the spot diameter d and the pitch p between the adjacent spots placed in the rectangular pattern shown in FIG. 10 as $d=\sqrt{2}p$. The pitch p is sometimes also called the intrinsic resolution of the printer. In the two examples of halftone cells 70, 72, drops of two sizes are formed, resulting in spots of two different sizes in each example. The spots of each size are placed, for example, at 42.3 μm pitch corresponding to the intrinsic resolution of 600 spots per inch (spi). The spots of one size are interdigitated with the spots of the other size as shown on FIG. 11 for textural printing and in the halftone cells 70 and 72 as shown in FIGS. 16 and 17.

Figure 18:
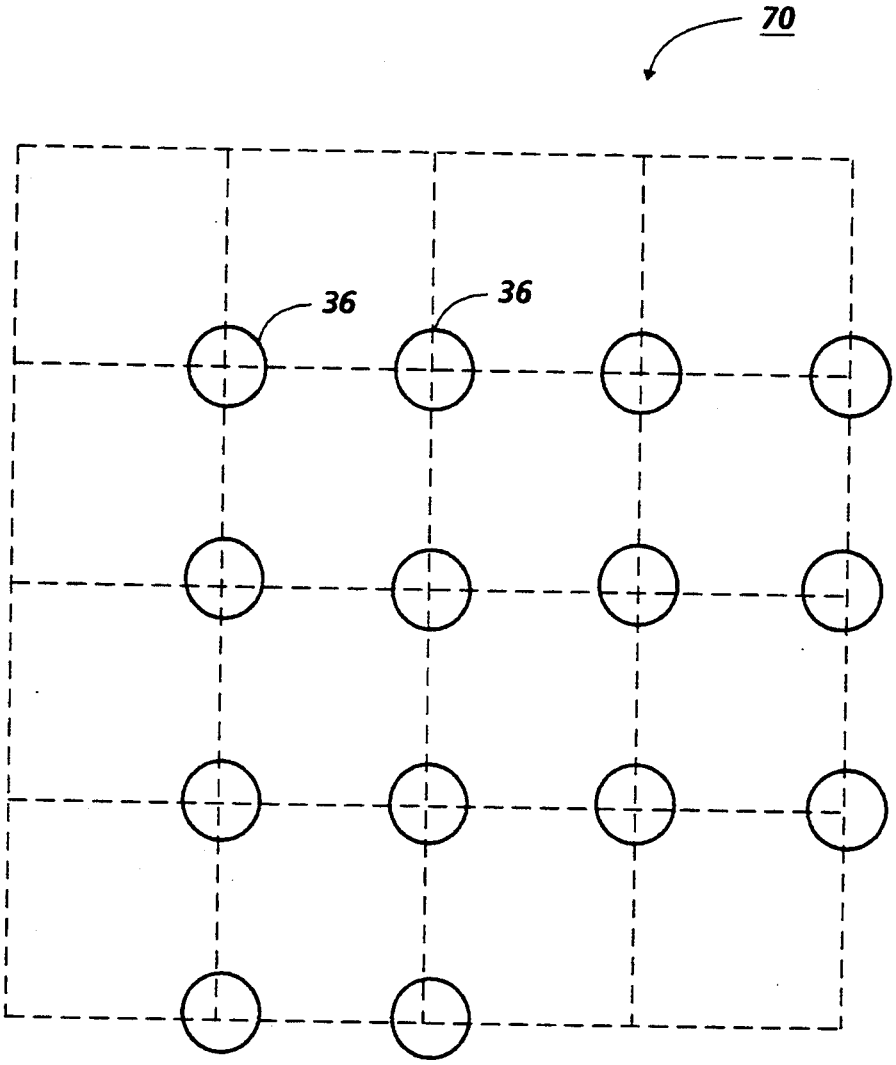
FIGS. 18–23 show several different 150 screen halftone cell levels.
Figure 19:
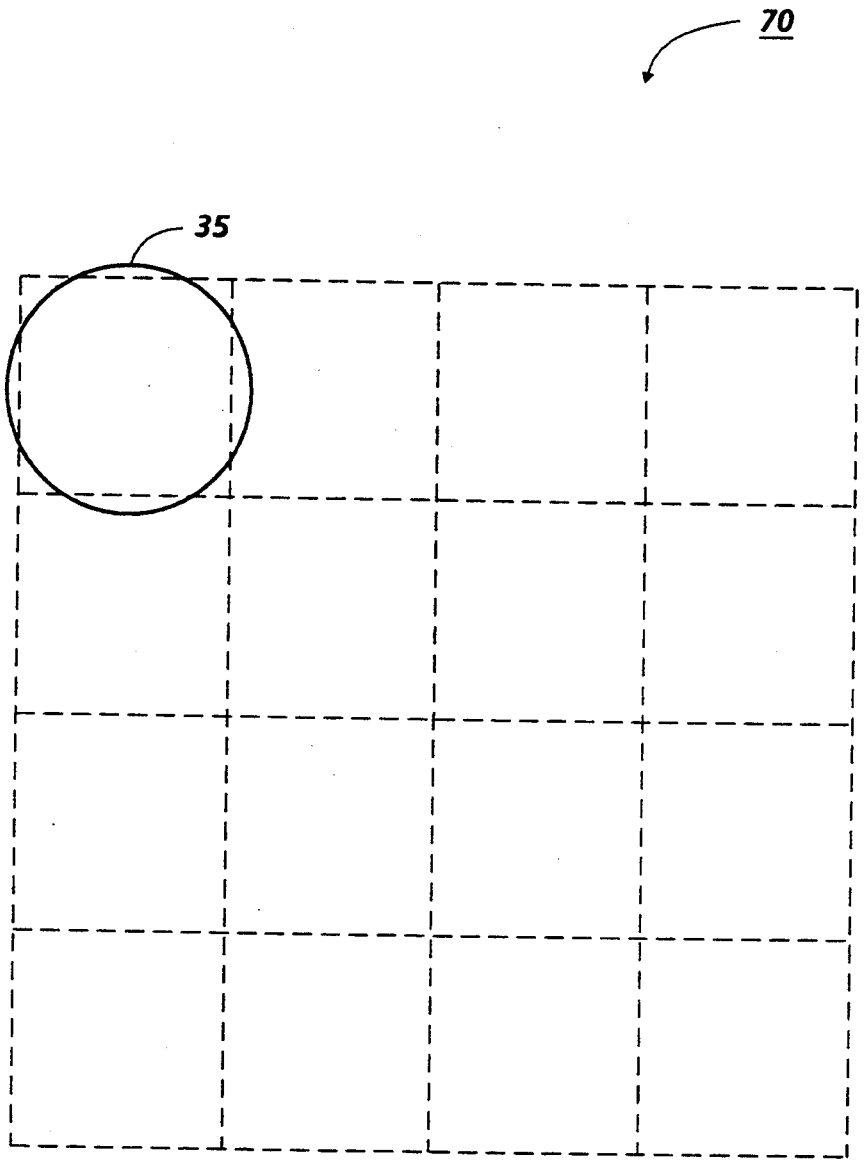
Figure 20:
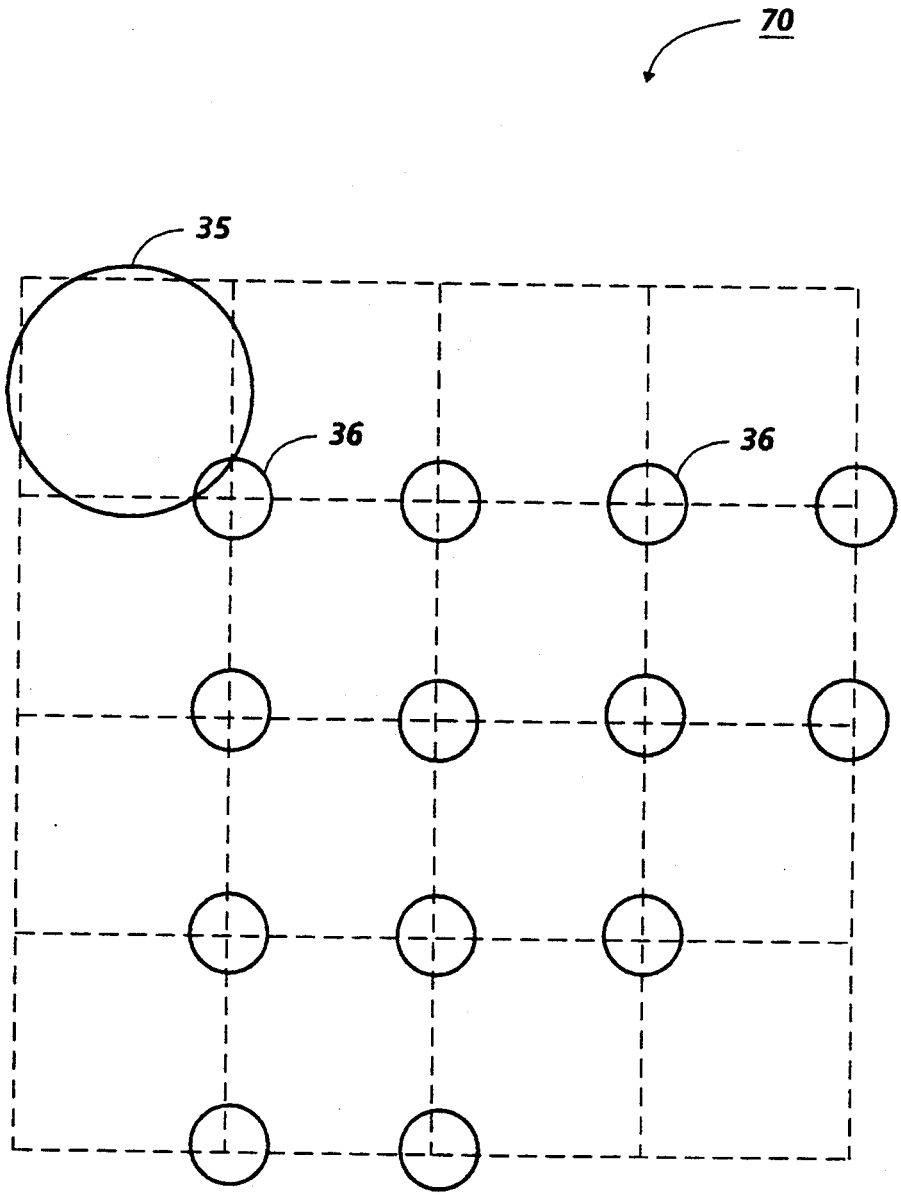
Figure 21:
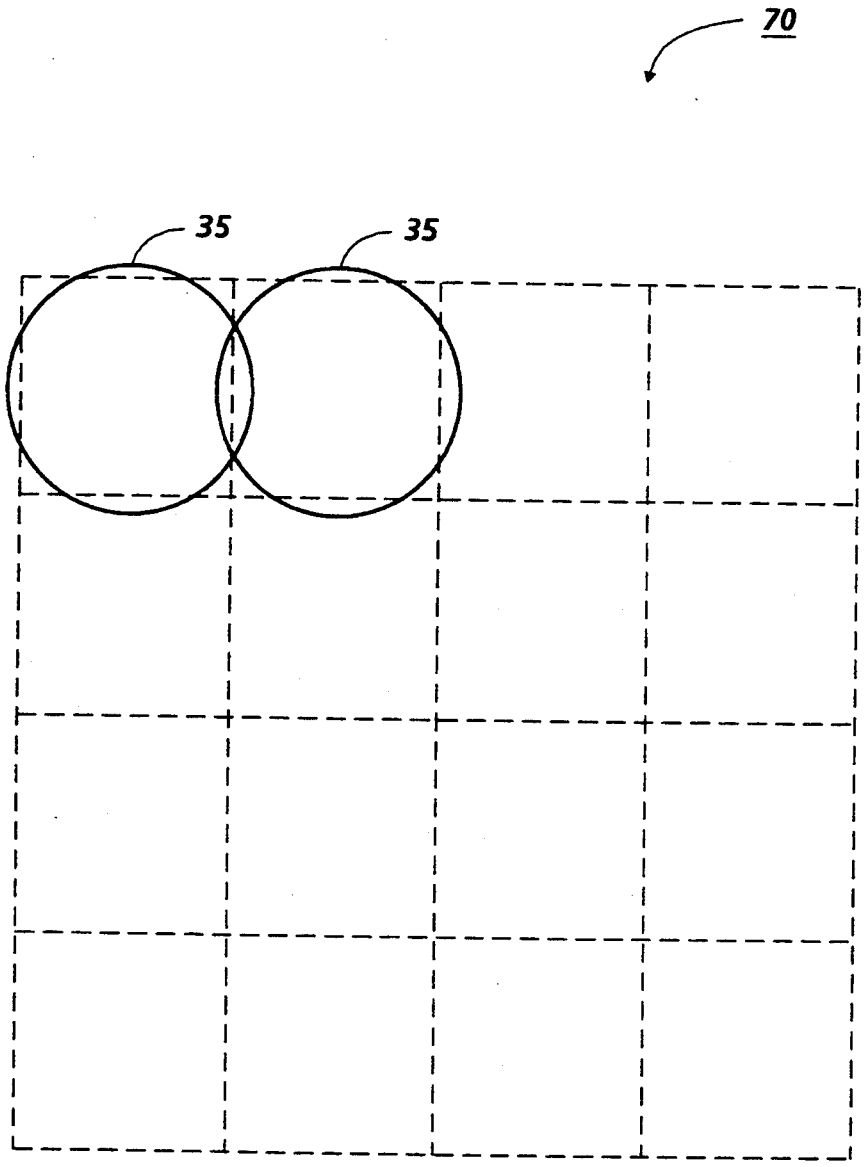
Figure 22:
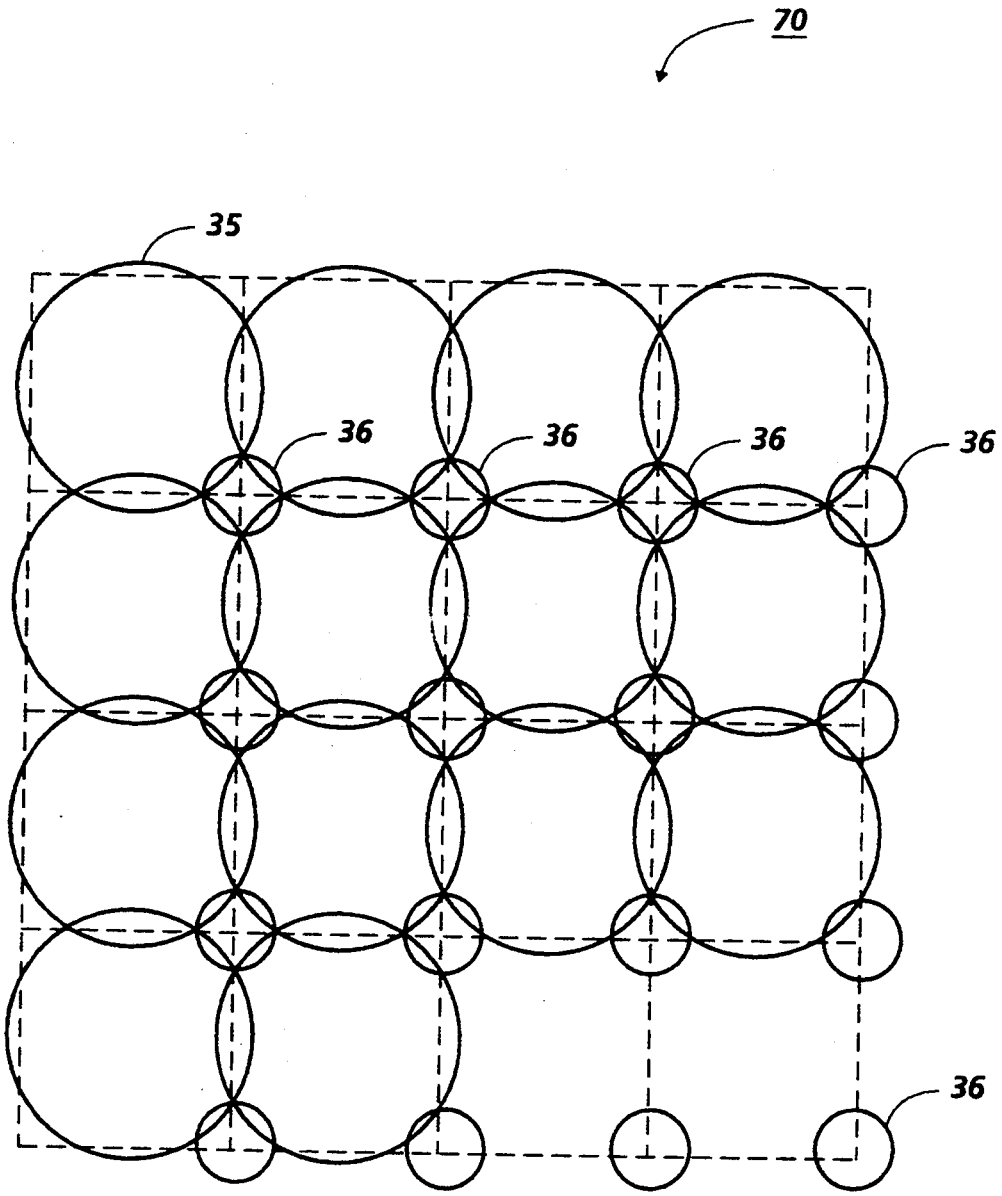
Figure 23:
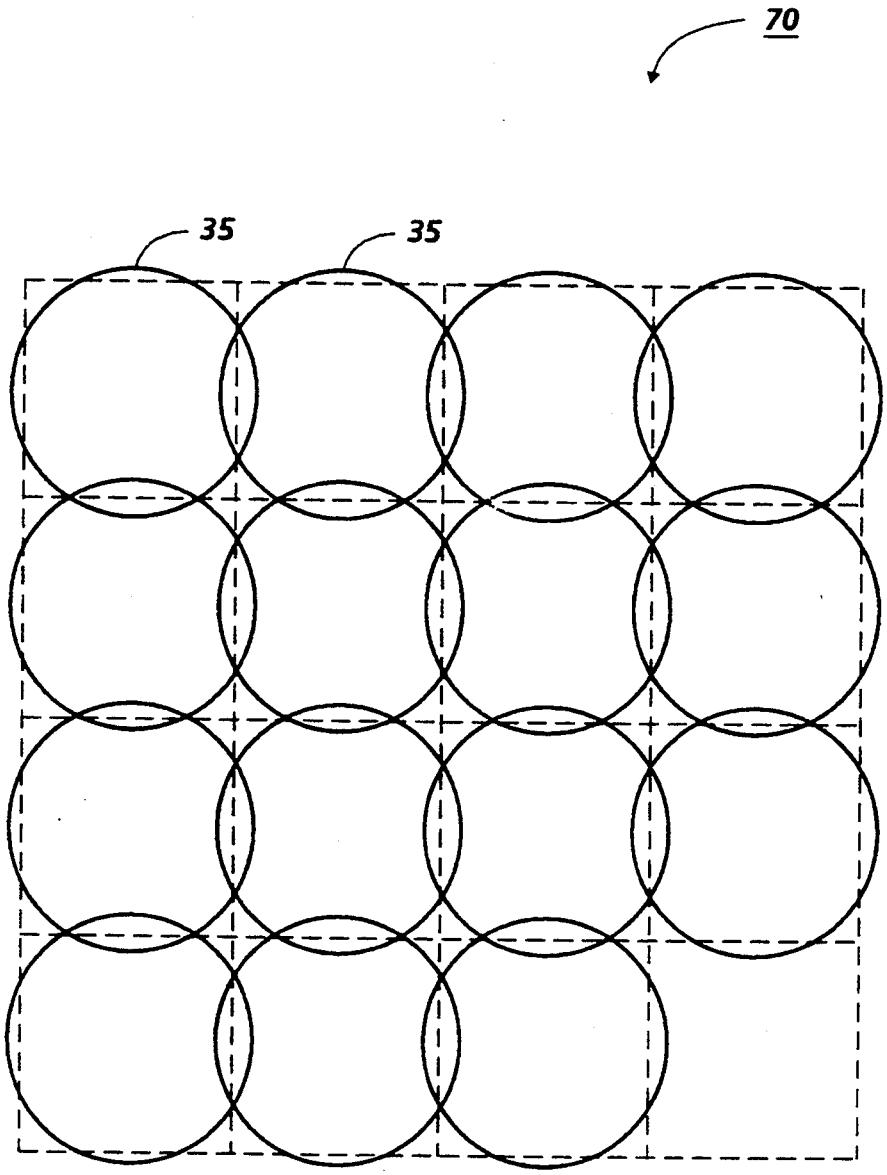

In the first example, the 150 screen halftone cell 70 has a square shape and is made of up to 16 large spots 35, in a 4 by 4 arrangement, interdigitated with 16 small spots 16, also in a 4 by 4 arrangement as shown in FIG. 16 wherein the placement of the spots for full area coverage is shown. The sequence of filling the cell 70 by the large spots is indicated by the numerals in each large spot. The filling sequence for small spots follows the sequence of large spots, except that sometimes not all 16 small spots are used. For quantitative illustration of this technique, an approximation of totally absorbing spots has been used. It has been found that under these approximations, the best tone reproduction curve is achieved when selecting the large spot diameter as 52.3 μm and the small spot diameter as 13.5 μm, the printed ink spot size of the preferred embodiment. With these dimensions, the largest step between the two successive values of absorbance reproducible by this technique, is 0.50%. This maximum step is created whenever an isolated, not overlapping, small spot is added to the halftone cell to generate next higher absorbance value. This maximum step is also created between the absorbance value achieved by a cell consisting of 14 large spots together with 16 small spots, and the next cell value constructed of 15 large spots and no small spot. At any other ratio of the large and small spot diameters, one of these two step magnitudes is always larger than 0.50%. The filling scheme is such that starting with empty cell, first one small spot 36 is used for the smallest non-zero absorbance, followed by 2,3, and so forth until 14 small spots are printed in halftone 70, as shown in FIG. 18. In FIG. 19, the next absorbance value for halftone cell 70 is achieved by one large spot 35 with no small spots 36. Above that, 1 to 13 small spots 36 are added to this one large spot in halftone cell 70 to move up the tone reproduction curve, as shown in FIG. 20. The next absorbance value for halftone cell 70 is achieved by placing two adjacent large spots 35 in the cell with no small spots, as shown in FIG. 21. Due to an influence the spot overlap has on the steps following the tone reproduction curve, all small spots are utilized when large numbers of large spots are being used. It has been found that the most critical transition is between a halftone cell in which 14 large spots and 16 small spots are being used, as shown in FIG. 22, and the next higher absorbance halftone cell in which 15 large spots are being used with no small spots, as shown in FIG. 23. In summary of this example, this invention creates continuous tone image at 150 screen with over 200 absorbance steps with differences smaller or equal 0.50%, as shown in plot 74 in FIG. 24 beginning at the low end of the tone reproduction curve and in FIG. 25 showing the high end of the tone reproduction curve.

Figure 24:
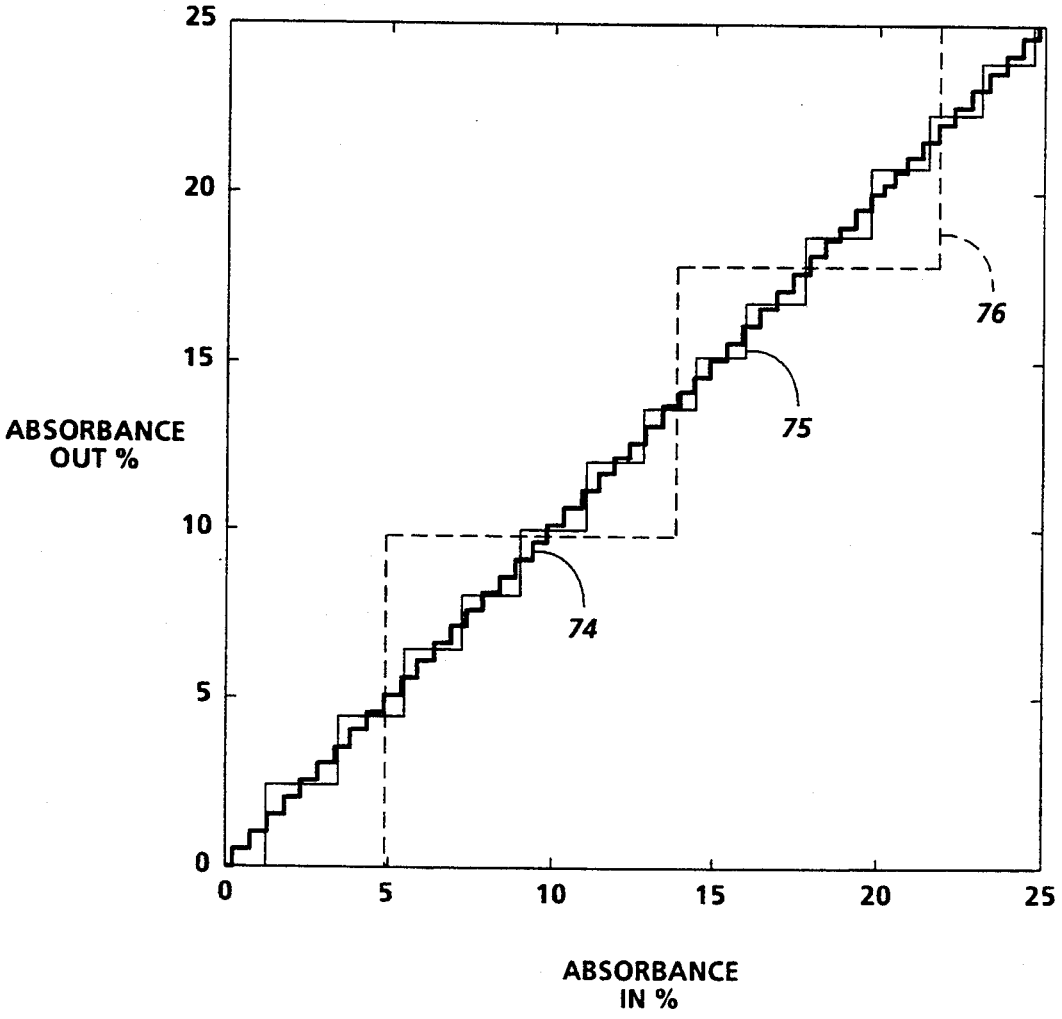
FIG. 24 shows a tonal plot of the low end of the tone reproduction curve for this invention versus the low end of the tone reproduction curve produced by the equal size spots printed by higher resolution prior art printers.
Figure 25:
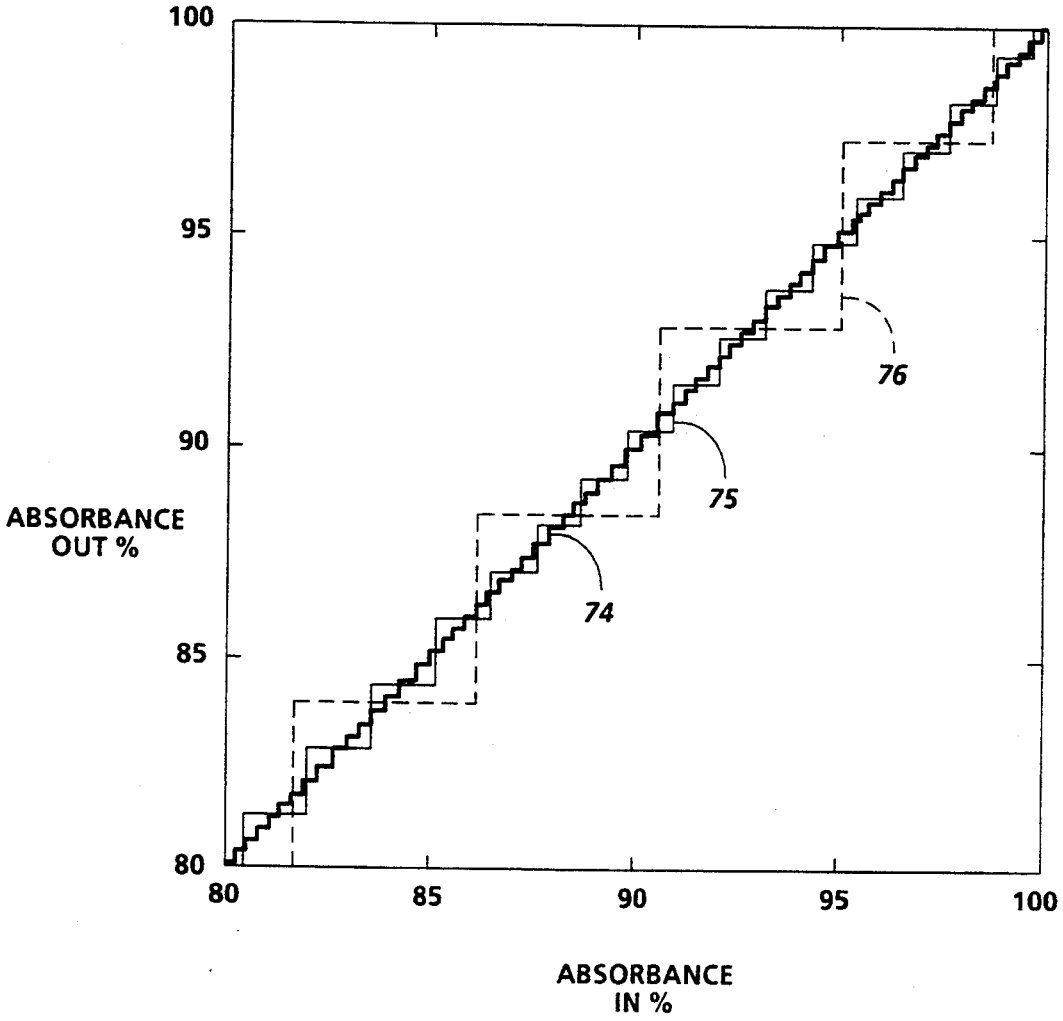
FIG. 25 shows a tonal plot of the high end of the tone reproduction curve for this invention versus the high end of the toner reproduction curve produced by the equal size spots printed by higher resolution prior art printers.

This result can be compared to the tone reproduction curve 75 of a prior art printer employing equal size spots printed at 1200 spi intrinsic resolution, also plotted in FIGS. 24 and 25. The same halftone cell is then constructed of up to 64 spots in 8 by 8 arrangement with the spot diameter of 29.9 μm. In spite of the fact that twice as many drops are now needed for full area coverage (64 vs. 32), this scheme provides only for 65 values of absorbance, with the maximum step of 2.5%, which is five times coarser than achieved by the printhead of the present invention when the images were printed at 150 screen. Another prior art plot 76 employing equal size spots printed at 600 spi intrinsic resolution shows an even larger step of absorbance.

Figure 26:
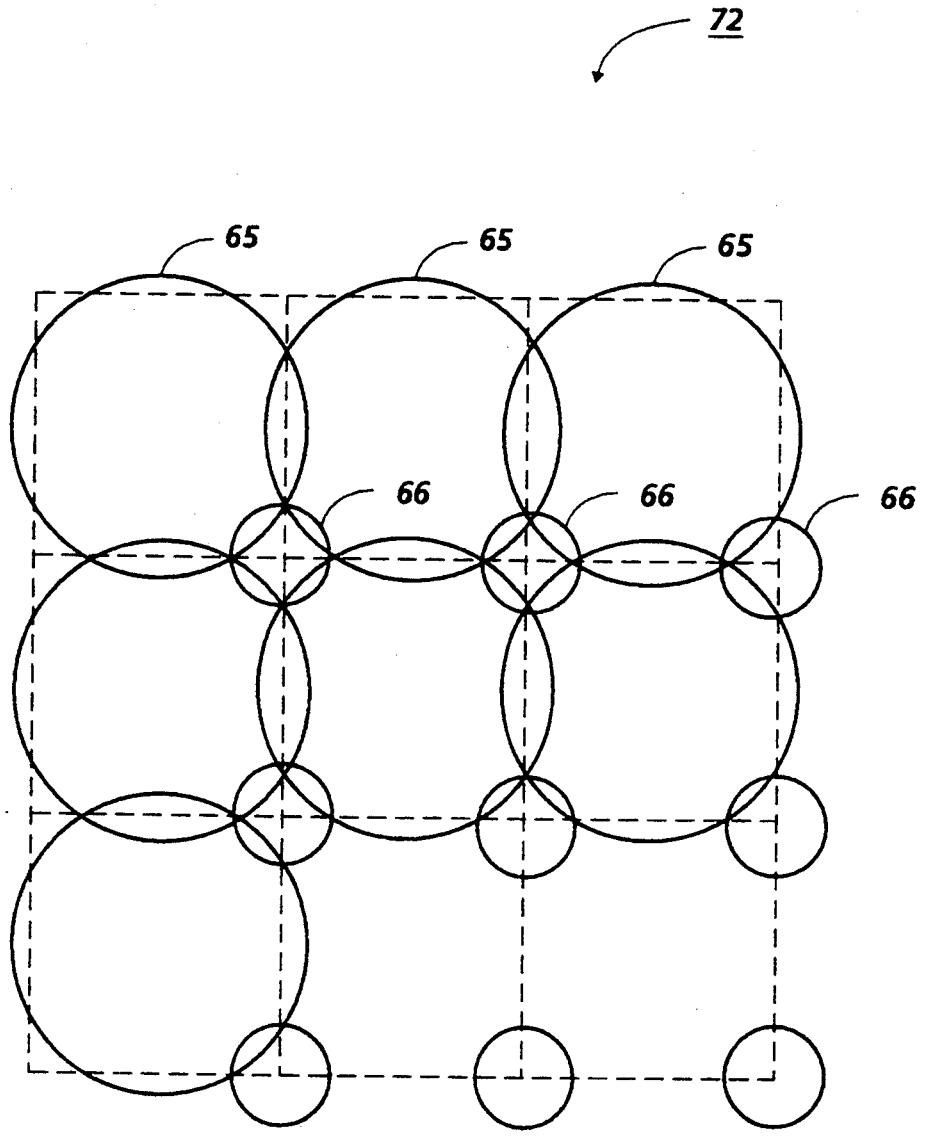
FIGS. 26 and 27 show two different 200 screen halftone cell levels.
Figure 27:
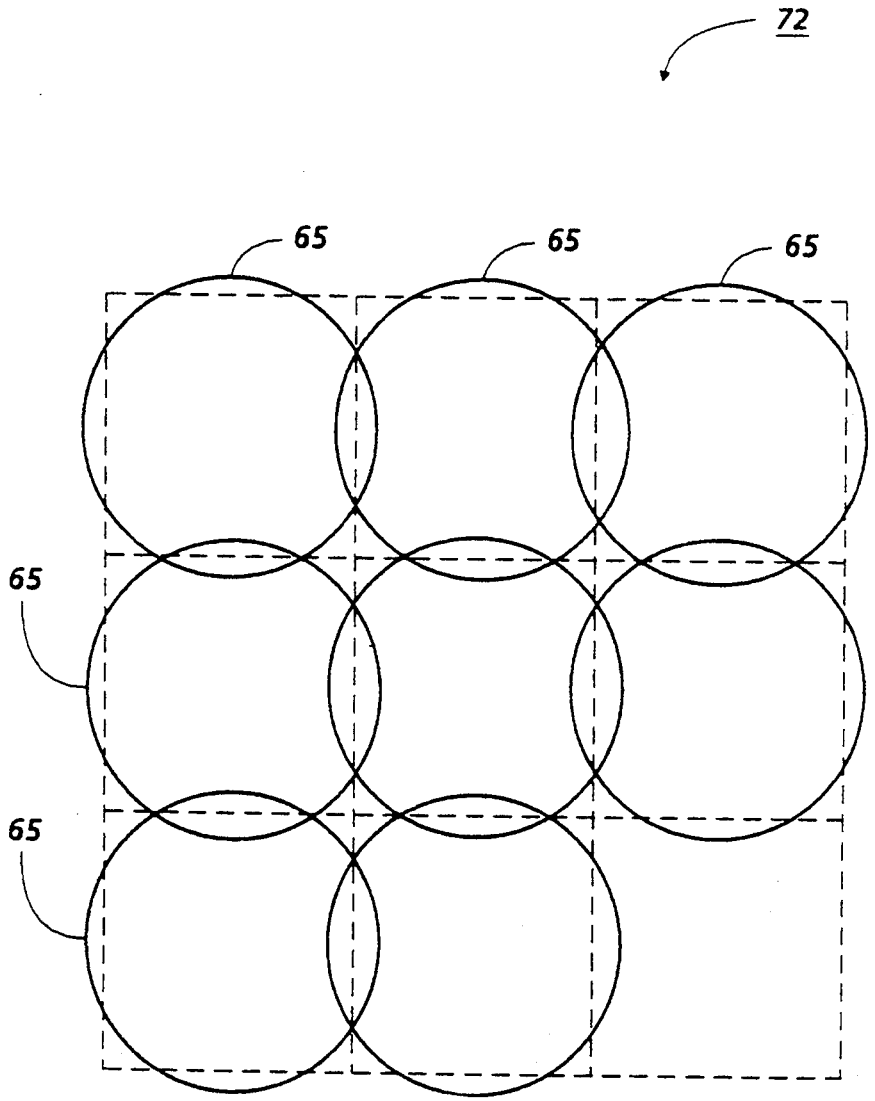

The second example, shown in FIG. 17, relates to the case when images are printed at 200 screen by halftone cells 72 consisting of 9 large spots 65 in a 3 by 3 square arrangement interdigitated in the above described manner with 9 small spots 66 also in 3 by 3 arrangement. The optimum, smoothest tone reproduction curve is achieved by making the large spot with 49.2 μm diameter and the small spot diameter 17.2 μm. The maximum increment of absorbance is 1.4% and it occurs each time when an isolated small spot 66 is added to make the next step in absorbance, and between the step with 7 large spots and 9 small spots, as shown in FIG. 26, and the step with 8 large spots and no small spot, as shown in FIG. 27. This technique then creates over 70 steps in absorbance. In comparison, when using prior art at 1,200 spi printing, a halftone cell of the same size needs twice as many drops (36 vs. 18) and much coarser steps in tone reproduction curve are achieved (4.4% vs. 1.4%).

Many modifications and variations are apparent from the foregoing description of the invention, and all such modifications and variations are intended to be within the scope of the present invention.

I claim:

1. An ink jet printhead for use in a printer to eject droplets of ink selectively from a plurality of nozzles therein onto a recording medium and to print selectively text images and continuous tone images, the printhead comprising:

at least a first group and a second group of different sized nozzles collinearly arranged in a face of the printhead, the nozzles from the first group of nozzles being equally and alternatively spaced with the nozzles from the second group of nozzles, the nozzle sizes in respective first and second nozzle groups being identical, either the nozzles from the first nozzle group or the nozzles from the first group and second group of nozzles in fixed combinations being used to print single pixels for text printing, and predetermined combinations of nozzles from each of the first and second groups of nozzles being used to compose and to print halftone cells comprising a plurality of pixels in a predetermined combination for continuous tone printing.

2. A thermal ink jet printhead for use in a printer to eject droplets of ink selectively onto a recording medium in a manner to control area coverage, so that the printhead prints both text images and continuous tone images, comprising:

a first substrate having parallel opposing first and second surfaces with a first array of passivated heating elements and addressing electrodes being on the first surface thereof and with a second array of passivated heating elements and addressing electrodes being on the second surface thereof, each of the heating elements being selectively energized in response to electrical pulses applied to the addressing electrodes, whereupon the energized heating elements produce droplet ejecting bubbles in ink in contact therewith;

a second substrate having a first surface mated to the first surface of the first substrate containing said first array of the heating elements and addressing electrodes, the first surface of the second substrate having a plurality of channels communicating with at least two predetermined different sizes of nozzles from which the ink droplets of different ink volumes are ejected, each nozzle having an associated heating element, and said nozzles having a predetermined linear spacing with alternating nozzles having alternately one and then the other of the two predetermined sizes;

a third substrate have a first surface mated to the second surface of the first substrate containing said second array of passivated heating elements and dressing electrodes, the first surface of the third substrate having a plurality of channels communicating with a plurality of nozzles having a predetermined size different from the nozzle sizes in the first surface of the second substrate; and means for selective energization of the heating elements associated with their respective nozzles to provide images printed in lines of pixels or spots for text printing and images printed front halftone cells for continuous tone printing.

3. The printhead of claim 2, wherein a thick film polymeric layer is sandwiched between the first and second surfaces of the first substrate, the first surfaces of the second and third substrates, the thick film polymeric layer being patterned to expose the heating elements, thereby placing each of the heating elements in a pit.

4. A pagewidth printhead for use in a printer for ejecting droplets of ink from nozzles therein onto a recording medium, the printhead selectively printing text images and continuous tone images, the printhead comprising:

a structural bar having opposing parallel surfaces and being fixedly mounted in the printer;

a plurality of abutted printhead subunits on at least one surface of the structural bar, each of the printhead subunits having at least a first group and a second group of different sized nozzles, the nozzle sizes within each group being identical, the nozzles from the first group of nozzles being alternatively spaced with the nozzles from the second group of nozzles, so that the nozzles from either the first group or the second group or the nozzles from both the first group and the second group in fixed combinations are used to print single pixels for text printing and predetermined combinations of nozzles are used from each of the first group and second group of nozzles to compose and print halftone cells comprising a plurality of pixels in a predetermined combination for continuous tone printing.

5. A method of printing text images and continuous tone images comprising the steps of:

selectively ejecting ink droplets from nozzles of a printhead having at least a first group and a second group of different sized nozzles, the nozzle sizes within each group being identical and the nozzles in the first group being alternately spaced from the nozzles in the second group;

printing rows of ejected ink droplets from the first group or from both the first group and the second group of nozzles to form text images by printing single pixels; and forming halftone cells comprising a plurality of pixels in a predetermined combination of single pixels in a length times width arrangement and printing the pixels in each half tone cell with combinations of ejected ink droplets from both the first and second groups of nozzles in order to print continuous tone images.

* * * * *